US011629865B2

(12) United States Patent
Simkins

(10) Patent No.: US 11,629,865 B2
(45) Date of Patent: Apr. 18, 2023

(54) DRY AIR SUPPLY SYSTEMS

(71) Applicant: Polygon US Corporation, North Andover, MA (US)

(72) Inventor: David Simkins, Stuart, FL (US)

(73) Assignee: Polygon US Corporation, North Andover, MA (US)

( * ) Notice: Subject to any disclaimer, the term of this patent is extended or adjusted under 35 U.S.C. 154(b) by 724 days.

(21) Appl. No.: 16/586,305

(22) Filed: Sep. 27, 2019

(65) Prior Publication Data

US 2020/0217526 A1 Jul. 9, 2020

Related U.S. Application Data

(60) Provisional application No. 62/807,975, filed on Feb. 20, 2019, provisional application No. 62/788,006, filed on Jan. 3, 2019.

(51) Int. Cl.
*F24F 3/14* (2006.01)
*F24F 3/06* (2006.01)

(52) U.S. Cl.
CPC ..... *F24F 3/1423* (2013.01); *F24F 3/06* (2013.01); *F24F 2003/1435* (2013.01); *F24F 2003/1458* (2013.01)

(58) Field of Classification Search
CPC .... F24F 3/1423; F24F 3/06; F24F 2003/1435; F24F 2003/1458; F24F 1/04; F24F 3/14; F25B 27/02; B01D 2259/455
See application file for complete search history.

(56) References Cited

U.S. PATENT DOCUMENTS

| | | | |
|---|---|---|---|
| 2,926,502 | A | 3/1960 | Munters et al. |
| 3,247,679 | A | 4/1966 | Meckler |
| 4,113,004 | A | 9/1978 | Rush et al. |
| 4,594,860 | A | 6/1986 | Coellner et al. |
| 4,635,446 | A | 1/1987 | Meckler |
| 4,813,632 | A | 3/1989 | Woodhouse |
| 5,758,511 | A | 6/1998 | Yoho et al. |
| 6,199,388 | B1 | 3/2001 | Fischer, Jr. |
| 6,355,091 | B1 | 3/2002 | Felber et al. |

(Continued)

FOREIGN PATENT DOCUMENTS

EP 1191204 B1 4/2009

OTHER PUBLICATIONS

Novel Aire Technologies—Heat & Mass Transfer Products product information brochure, revised and printed Feb. 1, 2004.

(Continued)

*Primary Examiner* — Elizabeth J Martin
(74) *Attorney, Agent, or Firm* — McCarter & English, LLP

(57) ABSTRACT

An apparatus for dehumidifying ambient atmospheric air includes a first air path and a second air path. A heat exchanger system transfers at least a portion of radiated thermal energy to air drawn along the first air path to heat the air in the first air path and transfers at least a portion of the thermal energy from exhaust gas to air drawn along the first air path to heat the air in the first air path. The first air path connects the ambient atmosphere to a reactivation air outlet through the heat exchanger system and a desiccant in a second moisturized state, and the second air path connects the ambient atmosphere to a dried air outlet through the desiccant in a first dried state.

32 Claims, 14 Drawing Sheets

(56) References Cited

U.S. PATENT DOCUMENTS

| | | | | |
|---|---|---|---|---|
| 6,415,617 | B1 | 7/2002 | Seem | |
| 6,575,228 | B1 | 6/2003 | Ragland et al. | |
| 6,652,628 | B1 | 11/2003 | Hess | |
| 6,675,601 | B2 | 1/2004 | Ebara | |
| 6,889,750 | B2 | 5/2005 | Lagace et al. | |
| 6,892,795 | B1 | 5/2005 | Steele | |
| 6,978,635 | B2 | 12/2005 | Yabu et al. | |
| 7,007,495 | B2 | 3/2006 | Lee et al. | |
| 7,022,167 | B2 | 4/2006 | Hess | |
| 8,361,206 | B2 | 1/2013 | Hess | |
| 2002/0040575 | A1* | 4/2002 | Okano | F24F 13/24 60/39.511 |
| 2011/0214446 | A1* | 9/2011 | Fukudome | F24F 3/153 62/271 |
| 2012/0125199 | A1* | 5/2012 | Hess | F24F 3/1423 96/146 |

OTHER PUBLICATIONS

Ahmad A. Pesaran, "A Review of Desiccant Dehumidification Technology", National Renewable Energy Laboratory, Golden, CO, Prepared for: Proceedings of Electric Dehumidification: Energy Efficient Humidity Control for Commercia l and Institutional Buildings Conference,, New Orleans, Louisiana, Jun. 2-3, 1993.

PCT International Search Report and Written Opinion dated Dec. 2, 2019, in International Application No. PCT/US2019/053591.

* cited by examiner

| | A | B | C | D | E | F | G | H | I |
|---|---|---|---|---|---|---|---|---|---|
| Air flow CFM | 5000 | 5000 | 5000 | 5000 | 1400 | 300 | 1100 | 1400 | 1400 |
| Temperature °F | 79 | 79 | 120 | 122 | 79 | 400 | 170 | 219 | 110 |
| Moisture gr/lb | 78 | 78 | 37 | 37 | 78 | 78 | 78 | 78 | 224 |

DRY AIR SUPPLY SYSTEMS

CROSS-REFERENCES TO RELATED APPLICATIONS

This application claims the benefit of U.S. Provisional Application No. 62/788,006, filed Jan. 3, 2019 and U.S. Provisional Application No. 62/807,975, filed Feb. 20, 2019.

BACKGROUND OF THE INVENTION

Field of the Invention

This invention relates to systems for supplying dry air.

Description of the Related Art

Many factors can adversely affect the process of coating structures, such as steel tanks, steel supports, bridge components and the like. Among these adverse factors are those which can cause the steel to oxidize. Conditions promoting oxidation can arise from environmental factors, such as rain or high humidity in the air, or from improper surface preparation. Such conditions can arise without warning, for example, as a result of cool overnight temperatures producing condensation, or when an unanticipated weather system moves through.

In the event that oxidation occurs, it is necessary to perform corrective operations, such as re-blasting the metal, before any coatings can be applied. Absent such corrective operations, any subsequent coating may not adhere correctly or only weakly, with the result that the desired barrier properties of the coating are not achieved, or the coating life is shortened. Further, application warranties may be voided, and the integrity of the underlying structure may be negatively impacted, with damage requiring costly repairs if discovered, or even causing total failure and loss if undiscovered.

Prior to carrying out a structure treatment operation, for example by blasting to prepare its surface, or by applying a coating such as paint, it is sound practice for the contractor to first implement measures directed toward ventilating the environment, mitigating dust, and maintaining good air quality. In particular, after putting into place a dust collection system, it is generally desirable to install a dehumidification system specifically engineered to deliver dried air (air having a low relative humidity and dew point) to the environment in which is located the structure to be treated. Exposing the structure to such dried air not only lessens the risk of oxidation, but also allows the dust collection system to more effectively remove any residue from blasting operations, other unwanted particulate matter and possibly also undesired vapors.

For dehumidification, the use of desiccant dehumidification systems has grown in popularity as the most effective dew point and condensation control technology. Desiccants function by attracting and holding water molecules in air, thereby reducing the moisture content of the air. Able to attract and hold many, many times their dry weight in water vapor, desiccants are very effective in removing moisture from air even at lower humidity levels, and do not freeze when operated at low temperatures.

After the desiccant absorbs a quantity of moisture, it is typically subject to a reactivation process to remove the water, after which the reactivated desiccant can be used again. For large scale desiccant equipment, reactivation is typically done by heating, such as by electric heating, combustion heating using direct or indirect-fired burners fueled for example by natural gas or propane, or by steam heating in situations where a steam supply is present, such as may be available from a utility company in certain urban areas. However, if electric or combustion heating are the only options for reactivating the desiccant, there are drawbacks with both of these methods. Electrical heating requires a large amount of electric power, and in many if not most cases the coating operations occur in remote locations and utility service, including electric power, is not available. In these situations, the required electric power must be supplied by internal combustion engine-driven electric generators delivered and positioned onsite. The use of such generators for heating increases the cost of the coating operation, due to both the expense of purchasing or leasing a generator, and the considerable fuel and maintenance costs associated with operating it.

As an alternative, combustion heaters can be utilized to reactivate the desiccant. This again increases the cost of the structure treatment operations, and may even disadvantageously require supplying and maintaining on-site an inventory of different fuels; for example, diesel fuel for the electric generator and propane tanks for the desiccant reactivator.

SUMMARY OF THE INVENTION

The present invention provides an efficient system for dehumidifying and maintaining a low relative humidity and dew point in the air ducted to the surfaces of a structure to be prepared or coated—be it for example a tank, a vessel, a containment structure or otherwise. The present invention provides dried air continuously, twenty four hours a day, for as long as desired; for example, until a blasting process is complete, or during the time when a coating is applied and then dried, perhaps over a number of days, so that warranty requirements are met, and coating life is extended to the longest possible duration. The present invention features a continuous reactivation of the desiccant by heating it with what may be otherwise unused thermal energy generated by the internal combustion engine that is used to generate the electricity used in connection with producing dried air and delivering it to the structure being prepared or coated. Thus the present invention dispenses with the need to use electric heaters or propane burners to dry the desiccant utilized to generate low-humidity supply air, resulting in cost savings.

The present invention also lends itself to utilization with modularized sections that can be arranged on a mobile carrier, such as an open or closed cargo trailer, in a variety of orientations for optimizing the trailer size, consistent with component dimensions and applicable governmental regulations. Alternatively, in lieu of mounting the modularized sections directly on a trailer, such sections can be mounted on a skid to permit moving and placement with a forklift.

Thus in one aspect, the present invention is directed to an apparatus for dehumidifying ambient atmospheric air comprising an enclosure assembly configured to define a first air path and a second air path, and including a moisture-absorbing desiccant having a first dried state and a second moisturized state. There is also provided a heat exchanger system including first means for (a) receiving radiated thermal energy from an internal combustion engine, and (b) transferring at least a portion of the radiated thermal energy to air drawn along the first air path to heat the air in the first air path; and second means for (a) receiving exhaust gas containing thermal energy from an internal combustion engine, and (b) transferring at least a portion of the thermal energy from the exhaust gas to air drawn along the first air path to heat the air in the first air path. The first air path within said enclosure assembly connects the ambient atmosphere to a reactivation air outlet through the heat exchanger system and the desiccant in the second moisturized state, and the second air path within said enclosure assembly connects the ambient atmosphere to a dried air outlet through the desiccant in the first dried state. There is also provided a first blower configured to draw air from the ambient atmosphere along the first air path through the heat exchanger system to provide heated air, and to further draw the heated air along the first air path and through the desiccant in the second moisturized state, to change the desiccant from the second moisturized state to the first dried state, and a second blower configured to draw air from the ambient atmosphere along the second air path through the desiccant in the first dried state, to provide dried air at the dried air outlet and to change the desiccant from the first dried state to the second moisturized state.

In another aspect, the present invention is directed to a mobile apparatus for dehumidifying ambient atmospheric air comprising: (I) an air handling section having a generally rectangular footprint with a first length and a first width smaller than the first length, where the air handling section includes an enclosure assembly, a heat exchanger system, a first blower and a second blower; (II) an electric generator section having a generally rectangular footprint with a second length and a second width smaller than the second length, where the electric generator section includes an internal combustion engine that during operation generates radiated thermal energy and exhaust gas containing thermal energy, and which rotates an electric generator that generates electric power; and (III) a mobile trailer, adapted to roll in a longitudinal direction and defining a transverse direction perpendicular thereto, on which is mounted the air handling section and the electric generator section proximate to each other. The enclosure assembly is configured to define a first air path and a second air path, and contains a moisture-absorbing desiccant having a first dried state and a second moisturized state. The heat exchanger system includes first means for (a) receiving radiated thermal energy from the internal combustion engine, and (b) transferring at least a portion of the received radiated thermal energy to air drawn along the first air path to heat the air in the first air path; and second means for (a) receiving exhaust gas containing thermal energy from the internal combustion engine, and (b) transferring at least a portion of the exhaust gas thermal energy from the exhaust gas to air drawn along the first air path to heat the air in the first air path. The first air path within the enclosure assembly connects the ambient atmosphere to a reactivation air outlet through the heat exchanger system and the desiccant in the second moisturized state, and the second air path within the enclosure assembly connects the ambient atmosphere to a dried air outlet through the desiccant in the first dried state. The first blower is powered by electric power received from the electric generator and is configured to draw air from the ambient atmosphere along the first air path through the heat exchanger system to provide heated air, and to further draw the heated air along the first air path through the desiccant in the second moisturized state, to change the desiccant from the second moisturized state to the first dried state; and the second blower is powered by electric power received from the electric generator and is configured to draw air from the ambient atmosphere along the second air path through the desiccant in the first dried state, to provide dried air at the dried air outlet and to change the desiccant from the first dried state to the second moisturized state. The air handling section is mounted on the trailer in an orientation such that the first length is generally parallel to either the longitudinal direction or the transverse direction, and the electric generator section is mounted on the trailer in an orientation such that the second length is generally parallel to either the longitudinal direction or the transverse direction.

These and other aspects of the present invention are described in the drawings annexed hereto, and in the description of the preferred embodiments and claims set forth below.

DETAILED DESCRIPTION OF THE PREFERRED EMBODIMENTS

Figure 1A:
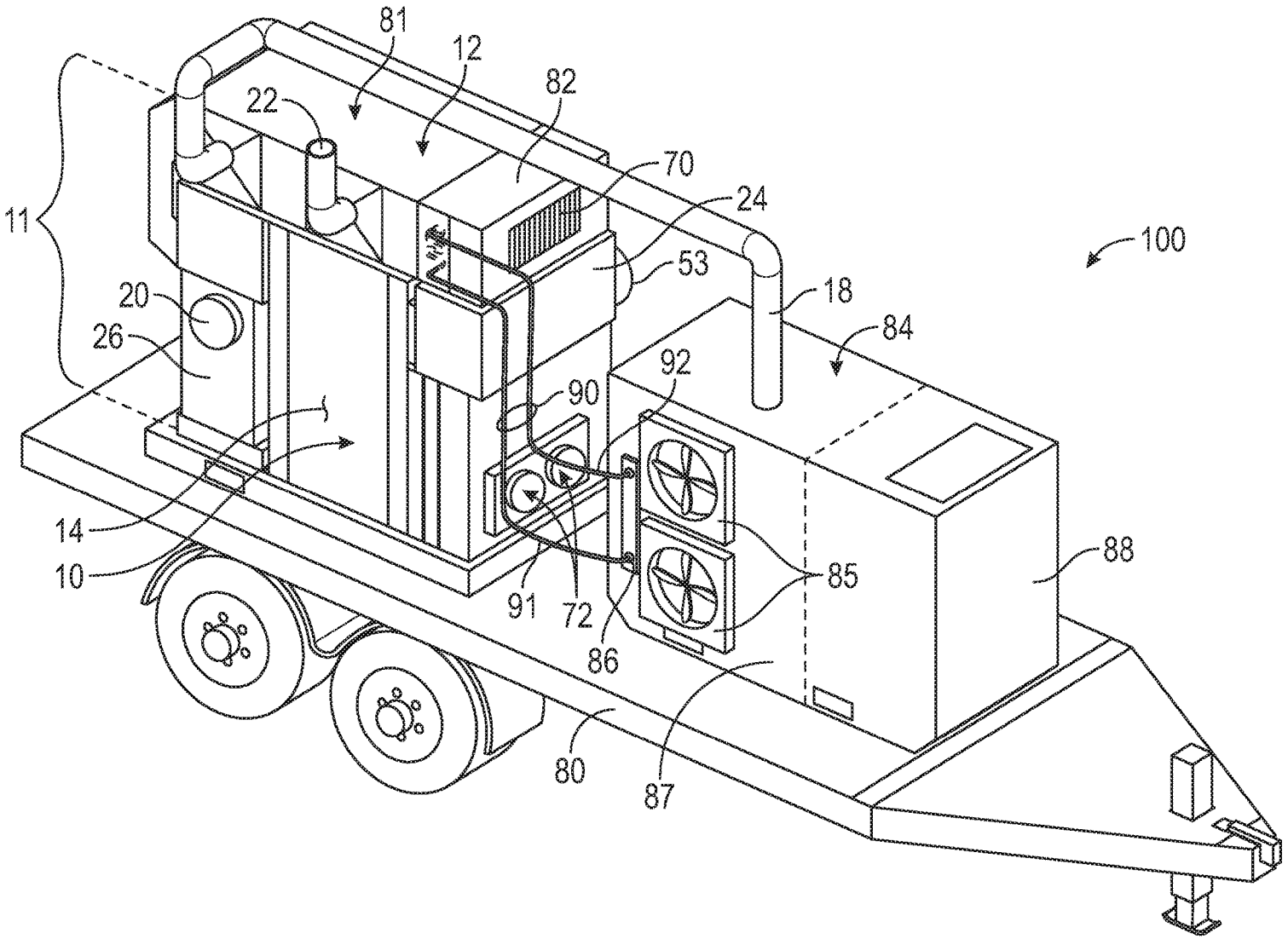
FIG. 1A is a schematic perspective view of a first embodiment of a dry air supply system in accordance with the present invention mounted on a truck trailer.

The dry air supply systems of the present invention comprises two principal sections, namely an electric generator section and an air handling section. As described further below, the electric generator section (such as electric generator section 84 of dry air supply system 100, shown in FIG. 1A) and the air handling section (such as air handling section 11 of dry air supply system 100, shown in FIG. 1A) can be skid mounted and/or mounted on a mobile trailer such as would typically be pulled by a truck (such as mobile trailer 80, shown in FIG. 1A) adjacent/proximate to each other (such as depicted in FIG. 1A), for ease of transport to and from a job site, and to facilitate handling at the job site. Alternatively, the two principal sections (for example air handling section 11 and electric generator section 84 shown in FIG. 1A) can each be delivered separately to a job site, either on trailers or otherwise, and then coupled together as described herein adjacent the job site prior to use.

The dry air supply systems described herein can be implemented in different embodiments, as described below. In the drawings and written description of the different embodiments, like numerical references designate the same components.

Dry Air Supply System (100)

Figure 1B:
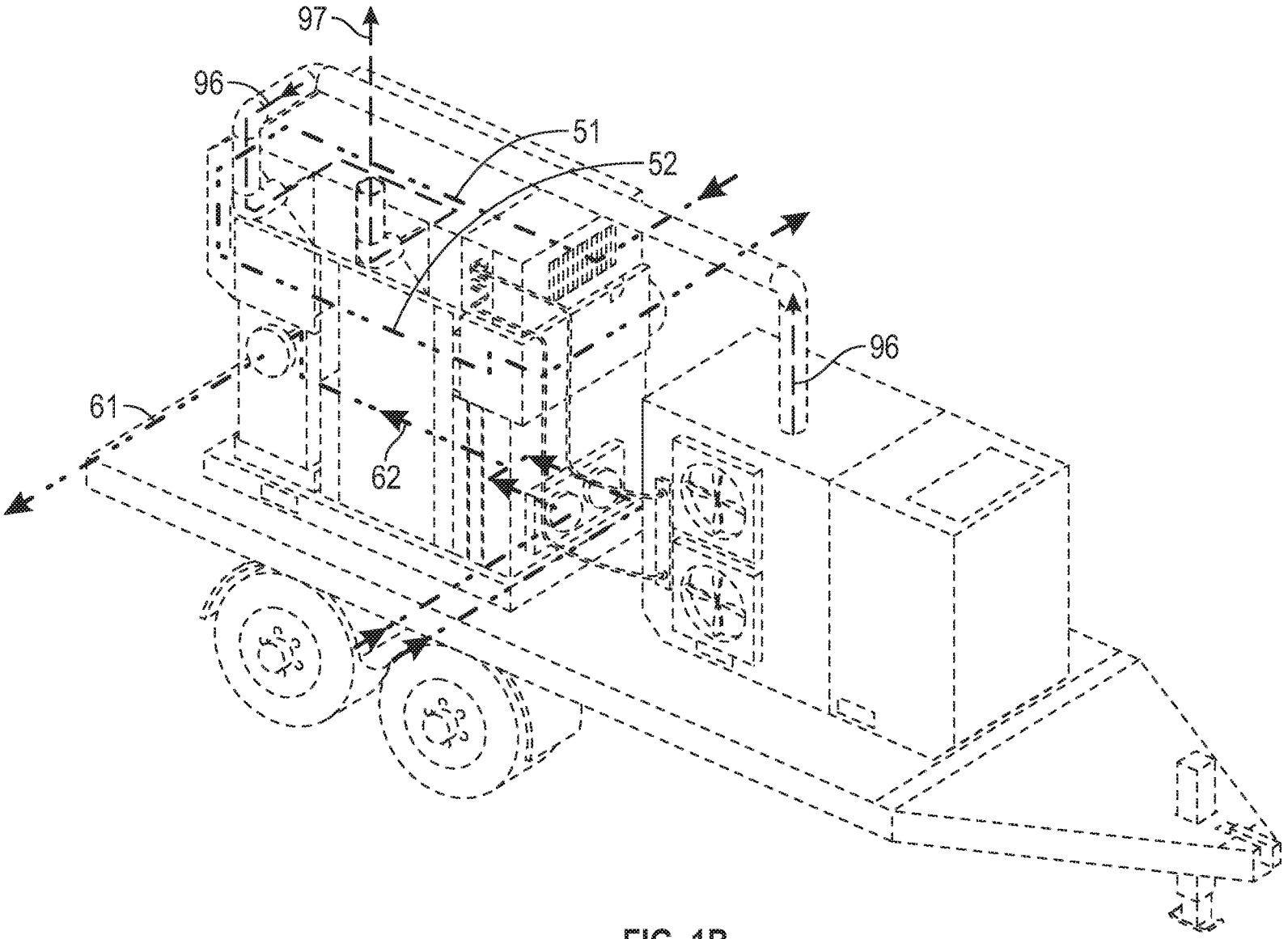
FIG. 1B is a schematic perspective view showing the air and exhaust gas flow paths of the present invention, with the dry air supply system of FIG. 1A depicted by dashed lines to better highlight those flow paths.

Dry Air Supply System 100 is shown in FIGS. 1A and 1B. The principal sections of dry air supply system 100 are electric generator section 84 and air handling section 11.

Electric Generator Section (84)

Referring to FIG. 1A, electric generator section 84 includes an internal combustion engine 87 that rotates an electric generator 88 within section 84 to produce electricity. The electricity produced by electric generator 88 in electric generator section 84 is used to power air handling section 11. Any electricity beyond the needs of air handling section 11 can be made available via suitable electrical sockets and the like for other electrical needs at the job site, such as to power spray equipment, lighting, etc. Suitable systems that can be utilized for use as electric generator section 84 are commercially available.

The energy released by the fuel-air combustion in the internal combustion engine 87 within electric generator section 84 is in part converted to mechanical energy to rotate electric generator 88 and thus generate electricity. The rest of the energy produced by the fuel-air combustion is released as thermal energy. Some of this thermal energy will be contained in the exhaust gas. The balance of this thermal energy (the portion not contained in the exhaust gas) will flow out from the internal combustion engine 87. In the case where engine 87 is an air cooled engine, this thermal energy will all be transferred from engine 87 into the ambient air by convection, conduction and/or radiation, optionally assisted by cooling fins positioned on the engine and/or a cooling fan or fans. In the case where engine 87 is a liquid cooled engine, this thermal energy will be transferred in substantial part by conduction to a liquid engine coolant circulated in coolant passages within engine 87 and then by means of convection, conduction and/or radiation to the ambient air through one or more radiators 85, with the balance transferred from engine 87 directly to the ambient air by convection, conduction and/or radiation. In a preferred embodiment, internal combustion engine 87 is a liquid cooled, compression-ignition (diesel) reciprocating engine.

In this disclosure, all energy released in combustion by the internal combustion engine 87 that is neither converted to mechanical energy to rotate the electric generator, nor contained within the exhaust gas, is referred to as "radiated thermal energy" for convenience. In this invention, it is preferred that both radiated thermal energy, such as may be contained in a liquid engine coolant, and thermal energy contained in the exhaust gas, be advantageously utilized in air handling section 11.

In one preferred embodiment, internal combustion engine 87 includes one or more radiators 85, shown in FIG. 1A, through which circulates an engine coolant, specifically a liquid engine coolant such as a glycol/water mixture. Radiators 85 assist in the transfer of radiated thermal energy to the ambient air, as described above. In a preferred embodiment, there is provided a hot fluid diverter valve 86 connected to the engine coolant circuit, in this case, proximate to radiators 85, to divert at least a portion of the liquid coolant through piping 90 for utilization in the air handling section 11, specifically in the air heating section 12.

Air Handling Section (11)

Air handling section 11 includes an air heating section 12 and an air drying section 10, both shown in FIG. 1A. Air handling section 11 defines two principal air paths, namely dry air path 61 and reactivation air path 51, schematically depicted in FIG. 1B. As shown in FIG. 1A, air handling section 11 includes a reactivation blower 24 interposed in reactivation air path 51 proximate its discharge end. Reactivation blower 24 is powered by electricity supplied by electric generator 88 so as to move air along reactivation air path 51. Air handling section 11 further includes a dry air blower 26 interposed in dry air path 61 proximate its discharge end. Dry air blower 26 is powered by electricity supplied by electric generator 88 so as to move air along dry air path 61.

In the embodiment of FIG. 1A, dry air path 61 starts at dry air inlets 72, passes through air drying section 10 and blower 26, and then ends at dry air outlet 20. In the embodiment of FIG. 1A, reactivation air path 51 starts at reactivation air inlet 70, located at the entrance to air heating section 12, passes through air heating section 12, air drying section 10 and blower 24, and then ends at reactivation air outlet 53. For purposes of illustrating general flow concepts, FIG. 1B includes a schematic depiction of dry air path 61 and reactivation air path 51. Both dry air path 61 and reactivation air path 51 receive air from the surrounding ambient atmosphere through their respective air inlets, and discharge air from their respective outlets.

Air Heating Section (12).

Air heating section 12 includes a first heat exchanger 82 and a second heat exchanger 81. In the embodiment of FIG. 1A, the heat exchangers are positioned in series, so that the air drawn along path 51 is first heated within first heat exchanger 82, and then further heated within second heat exchanger 81. In the embodiment of FIG. 1A, the first heat exchanger 82 functions to transfer radiated thermal energy from engine 87 to air flowing along reactivation air path 51, and the second heat exchanger 81 functions to transfer thermal energy from the exhaust gas of engine 87 to air flowing along reactivation air path 51. A serial arrangement of heat exchangers 82 and 81 as utilized in the embodiment of FIG. 1A can also be utilized in the longitudinal-transverse arrangement of FIG. 2A and in the all-transverse arrangement of FIG. 4.

In the preferred embodiment where engine 87 is liquid cooled, it is preferred that the first heat exchanger 82 comprises a liquid-to-gas heat exchanger, such as a coil placed in reactivation air path 51. Suitable coils for use as first heat exchanger 82 are commercially available. As shown in FIG. 1A, first heat exchanger 82 is connected to diverter valve 86 via supply pipe 91 of piping 90 to receive radiated thermal energy contained in the liquid engine coolant of internal combustion engine 87. Some of this radiated thermal energy is transferred within first heat exchanger 82 to air drawn along reactivation air path 51. It is generally preferred that the thermal energy requirements and operation of first heat exchanger 82 be subordinated to the needs of internal combustion engine 87 to maintain temperatures sufficiently elevated to oxidize VOC and other pollutants generated as a byproduct of combustion.

Figure 3:
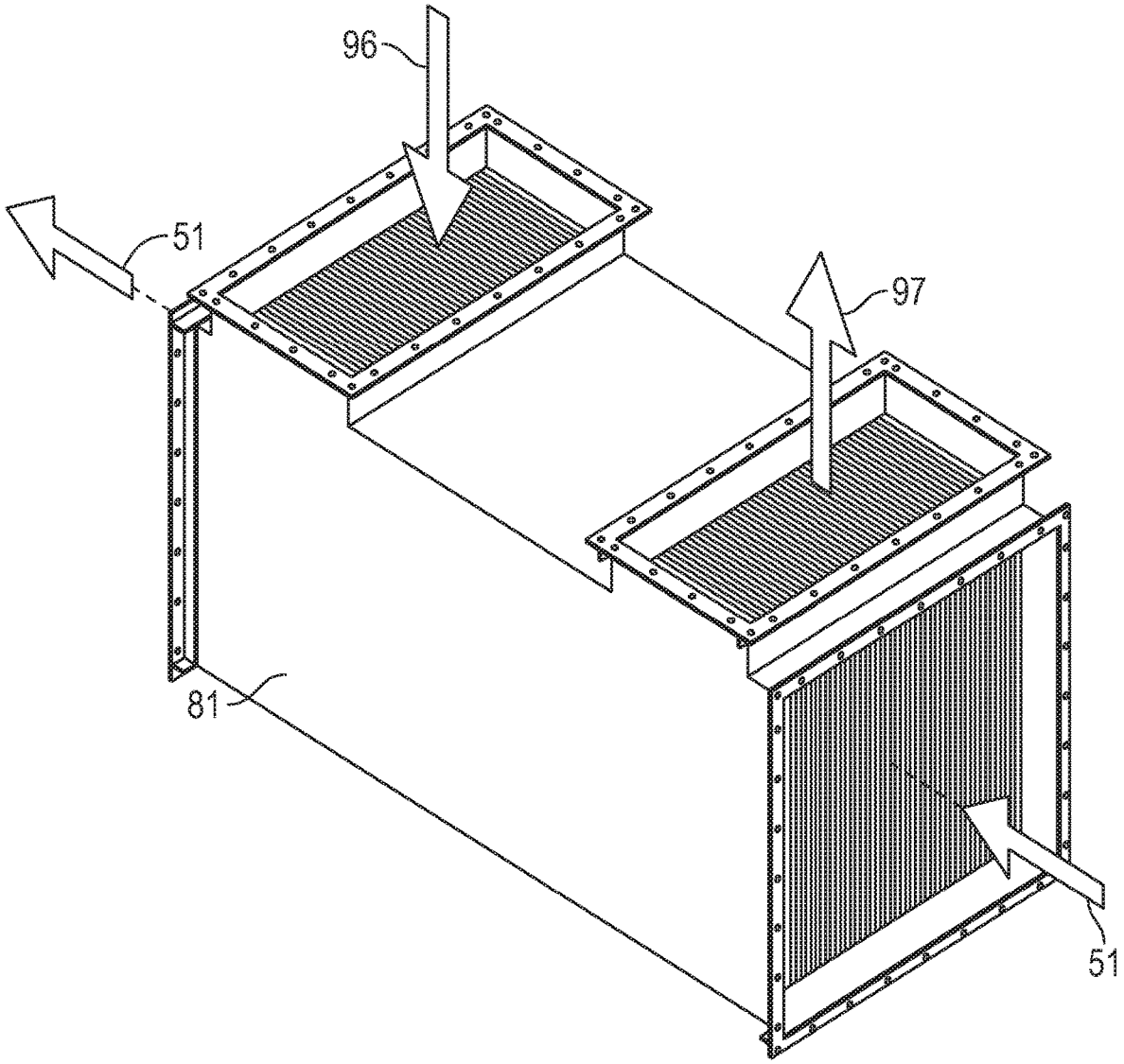
FIG. 3 is a schematic perspective view of the gas-gas heat exchanger utilized in the present invention to heat the desiccant reactivation air stream.

It is also preferred in the present invention that the second heat exchanger 81 comprises a gas-to-gas heat exchanger, shown for example in FIGS. 1A and 3. Second heat exchanger 81 is connected to the exhaust of internal combustion engine 87 via exhaust gas transfer pipe 18 to receive thermal energy contained in the hot exhaust gas stream 96, shown entering second heat exchanger 81 in FIGS. 1B and 3. Some of this thermal energy is transferred within heat exchanger 81 to heat air drawn along reactivation air path 51. The discharged exhaust gas stream 97, shown exiting second heat exchanger 81 in FIGS. 1B and 3, is conducted and discharged through exhaust stack 22.

Given the high temperature of the exhaust gas, it is preferred that second heat exchanger 81 be suitably designed and constructed for such service. In particular, it is preferred that second heat exchanger 81 be adapted to handle air heated to more than about 1000° F. (more than about 538° C.) and to effectively transfer thermal energy from the hot exhaust gas stream 96 from the engine 87, such as by utilizing a plate heat exchanger design made of heavy gauge alloy stainless steel and configuring the heat exchanger to provide a smooth, continuous path for minimum air resistance. In such a design, it is preferred that the heat transfer plates be completely seam-welded to prevent cross-contamination, and that expansion joints be provided to enable flange-to-flange ductwork installation without the need to compensate for thermal expansion. In general, appropriate design factors should be incorporated into second heat exchanger 81 to allow thermal expansion of the heat exchanger plates, while maintaining the air path integrity and preventing crossover of the exhaust gas with the reactivation air path 51.

Air path 51 preferably is appropriately arranged so that blower 24 draws air along that path through second heat exchanger 81 in a direction opposite the direction of the exhaust gas flow through second heat exchanger 81. Thus as shown in FIG. 1B and with reference to FIG. 1A, the flow of air along reactivation air path 51 is generally from right to left through second heat exchanger 81, whereas exhaust gas streams 96 and 97 generally define a flow from left to right through second heat exchanger 81. Such a flow arrangement is also referred to as a "counter-flow" design.

After heating air drawn along reactivation air path 51 in first heat exchanger 82, the engine coolant is returned via return pipe 92 of piping 90 to engine 87. After heating air drawn along reactivation air path 51 in second heat exchanger 81, the exhaust gas ultimately is discharged to the atmosphere through exhaust stack 22, as indicated above. Suitable pollution control and/or noise mitigation devices can be interposed in the exhaust gas path at appropriate locations.

Air Drying Section (10).

Air drying section 10 includes a desiccant wheel 14 mounted to rotate on a frame within section 10. Desiccant wheel 14 is generally permeable to air flow and is comprised of honeycombed flutes that allow for laminar airflow through the wheel and which optimize the surface area of the desiccant to the air flow. Using a honeycombed design for desiccant wheel 14 maximizes the total desiccant surface, allowing for a compact design and improved portability. Suitable desiccant wheels for utilization as desiccant wheel 14 in air drying section 10 of dry air supply system 100 are commercially available.

By means of appropriate wall and/or ducting placement, there is defined within air drying section 10 a desiccant feed path 62 (a portion of dry air path 61) and a desiccant reactivation path 52 (a portion of reactivation air path 51), shown in FIG. 1B, each passing through desiccant wheel 14.

Desiccant feed path 62 and desiccant reactivation path 52 preferably are appropriately arranged to provide a counter-flow design through desiccant wheel 14; i.e., blowers 24 and 26 draw air along desiccant feed path 62 (of dry air path 61) and along desiccant reactivation path 52 (of reactivation path 51) in opposite directions. Thus as shown in FIG. 1B, the flow in desiccant reactivation path 52 of reactivation air path 51 is from left to right in air drying section 10, whereas the flow in desiccant feed path 62 of dry air path 61 is from right to left in air drying section 10. Use of a counter-flow design within air drying section 10 improves the efficiency of the thermal dynamic process by allowing moisture that has been captured by the desiccant to be blown off the honeycomb, rather than being blown through the honeycomb and potentially captured again by desiccant, thereby requiring the recaptured moisture to be blown off again.

Desiccant wheel 14 is interposed in paths 52 and 62 so that air traveling along each path must pass through the thickness of wheel 14. Desiccant wheel 14 contains a suitable desiccant to remove moisture from air, such as a silica gel composition, which is particularly attractive for moisture collection. Desiccant wheel 14 is rotated in operation, preferably by an electric motor (not shown), powered by electricity supplied by electric generator 88 in electric generator section 84. The walls and/or ducting defining path desiccant reactivation path 52 and desiccant feed path 62 are appropriately configured to keep paths 52 and 62 substantially separate.

Dry Air Supply System (200)

Dry air supply system 200 is shown in FIGS. 2A-2D. The principal sections of dry air supply system 200 are electric generator section 284 and air handling section 211, shown in FIG. 2A.

The electric generator section 284 of dry air supply system 200 is substantially the same as electric generator section 84 described above in reference to dry air supply system 100. Suitable systems for use as electric generator section 284 of dry air supply system 200 are commercially available, such as a Tecnogen Model KL45FQ diesel-electric generator, available from Tecnogen S.p.A., Pontenure, IT.

The air handling section 211 of dry air supply system 200 is described below.

Air Handling Section (211)

Air handling section 211 includes an air heating section 212 and an air drying section 210. Air handling section 211 defines two principal air paths, namely dry air path 261 and reactivation air path 251, schematically depicted in FIG. 2C. Air handling section 211 includes a reactivation blower 24, shown in FIG. 2A, interposed in reactivation air path 251 proximate its discharge end, and a dry air blower 26 interposed in dry air path 261 proximate its discharge end.

In the embodiment of FIGS. 2A-2D, dry air path 261 starts at dry air inlet 272, passes through air drying section 210 and blower 26, and then ends at dry air outlet 220. It is preferred that a duct filter 73 be interposed in dry air path 261 upstream of desiccant wheel 14, for example proximate dry air inlet 272. Duct filter 73 (schematically depicted in FIG. 6) is provided to protect desiccant wheel 14 from ingested debris during operation.

In the embodiment of FIGS. 2A-2D, reactivation air path 251 includes two paths through air heating section 212, namely first HX path 251A and second HX path 251B. In particular, and with reference to FIGS. 2B and 2D, first HX path 251A starts at reactivation air inlet 270A, located at the entrance to air heating section 212, passes through first heat exchanger 82, and enters plenum 259. Likewise, second HX path 251B starts at reactivation air inlet 270B, located at the entrance to air heating section 212, passes through second heat exchanger 81, and enters plenum 259. It is preferred that a duct filter 71A be interposed in first HX path 251A upstream of desiccant wheel 14, for example proximate to reactivation air inlet 270A, and a duct filter 71B be interposed in second HX path 251B upstream of desiccant wheel 14, for example proximate to reactivation air inlet 270B. Duct filters 71A and 71B (schematically depicted in FIG. 6) are provided to protect desiccant wheel 14 from ingested debris during operation. There can optionally be provided proximate to reactivation air inlet 270A an air volume control damper 271A (FIG. 2B), and there can optionally be provided proximate to reactivation air inlet 270B an air volume control damper 271B (FIG. 2B), each having an opposed blade design for example.

The air drawn along first and second HX paths 251A and 251B commingles in plenum 259. From plenum 259, reactivation air path 251 is redirected to and continues through air drying section 210 and blower 24, and then ends at reactivation air outlet 253, shown in FIG. 2A. For purposes of illustrating general flow concepts, FIGS. 2C and 2D include a schematic depiction of dry air path 261 and reactivation air path 251.

Air Heating Section (212).

Air heating section 212 of dry air supply system 200 includes a first heat exchanger 82 and a second heat exchanger 81. As depicted in FIG. 2B, the heat exchangers 82 and 81 are positioned in parallel. More particularly, by use of suitable ducting, as depicted in FIG. 2B and with reference to FIG. 2D, first HX path 251A is physically separate from second HX path 251B. Thus air drawn along first HX path 251A (FIG. 2D) is heated within first heat exchanger 82 (and not within second heat exchanger 81), while the air drawn along second HX path 251B (FIG. 2D) is separately heated within second heat exchanger 81 (and not within first heat exchanger 82). This parallel heating arrangement differs from the serial heating arrangement characterizing the dry air supply system 100 shown in FIG. 1A, where the heat exchangers are positioned in series so that the air drawn along path 51 is first heated within first heat exchanger 82, and then further heated within second heat exchanger 81.

Figure 2A:
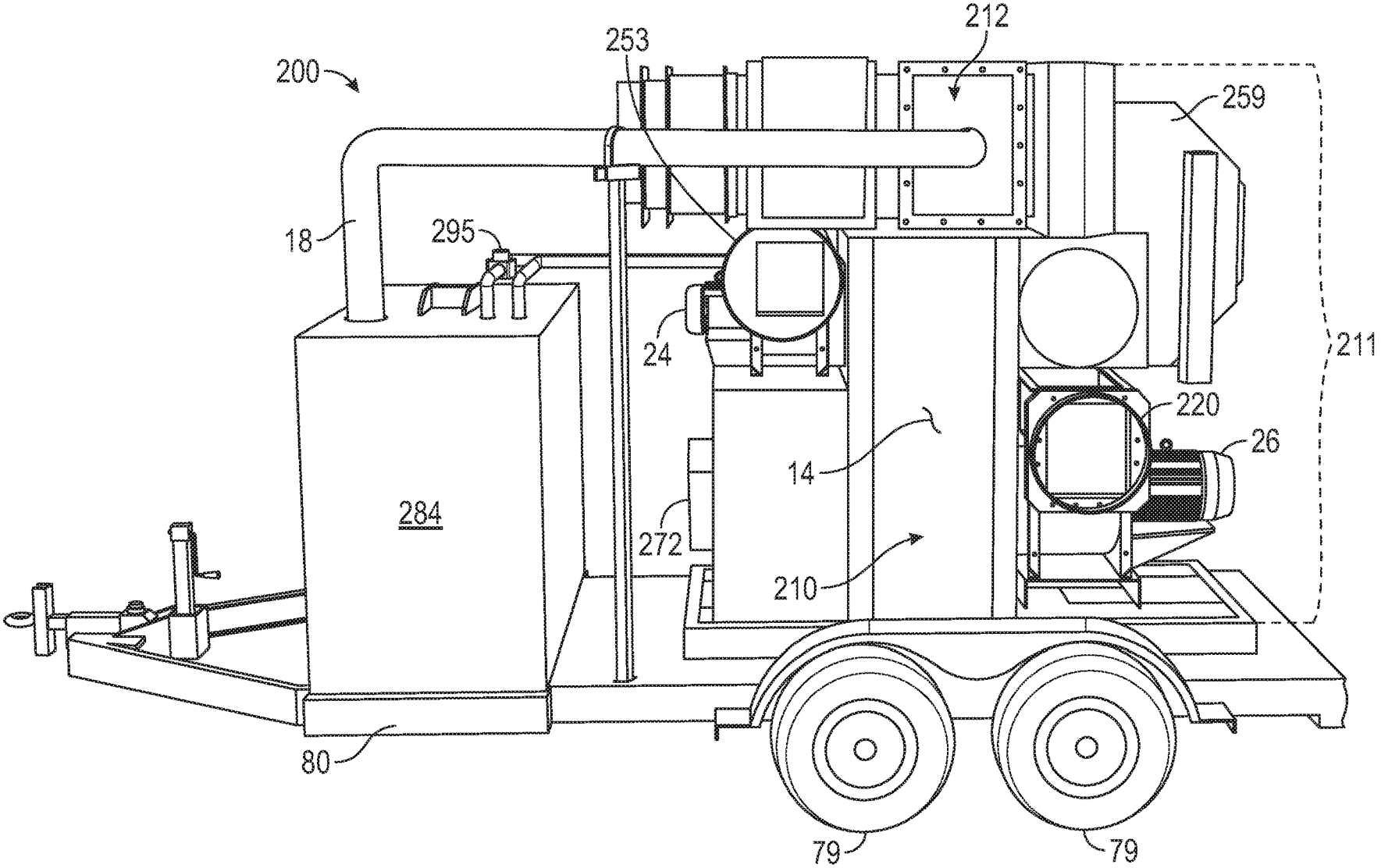
FIG. 2A is a schematic side view of a second embodiment of a dry air supply system in accordance with the present invention mounted on a truck trailer.
Figure 2B:
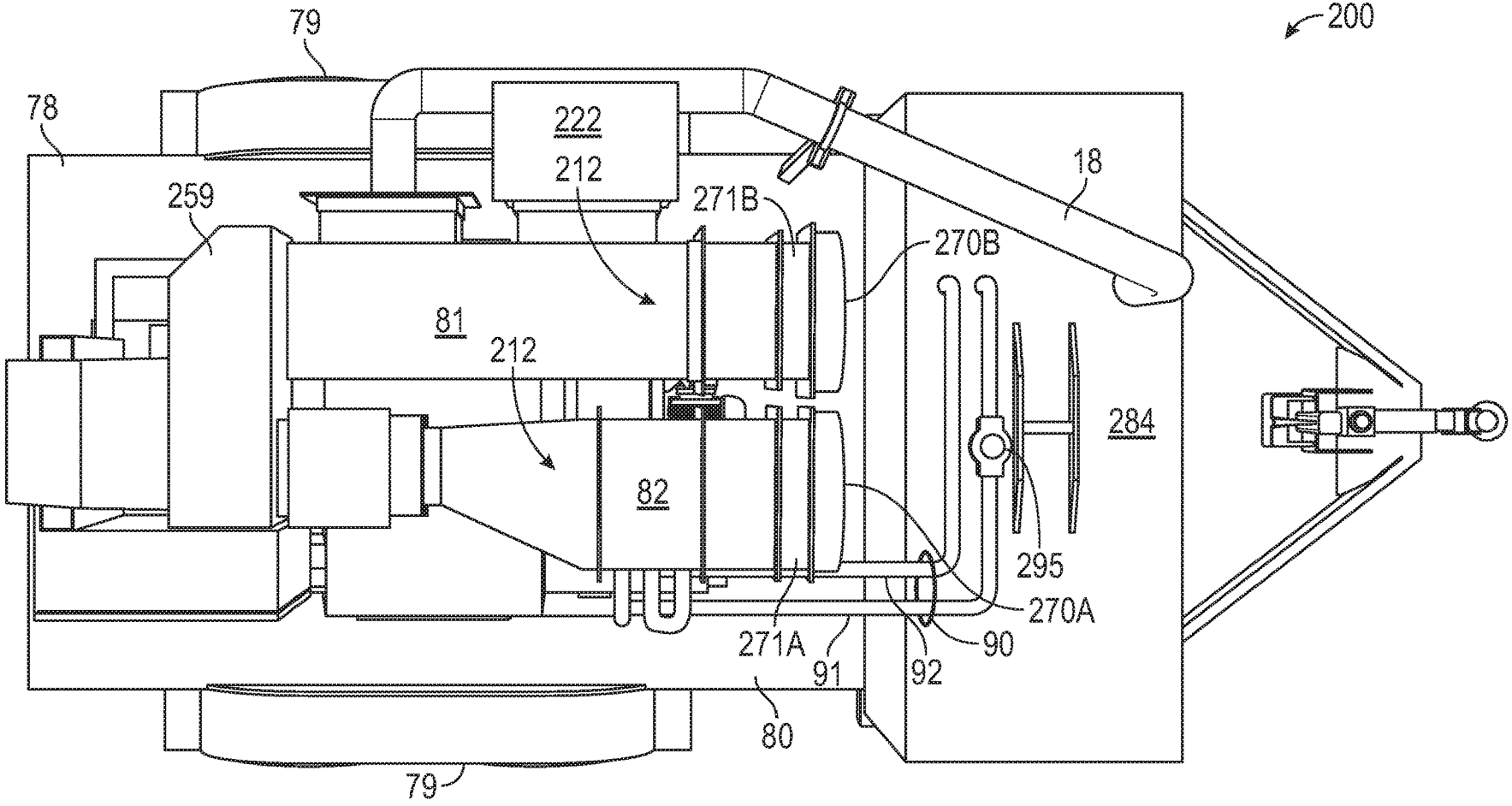
FIG. 2B is a schematic top view of the dry air supply system shown in FIG. 2A.

In dry air supply system 200 shown in FIG. 2A, the first heat exchanger 82 functions to transfer radiated thermal energy from engine 87 to air flowing along first HX path 251A, and the second heat exchanger 81 functions to transfer thermal energy from the exhaust gas of engine 87 to air flowing along second HX path 251B. A parallel arrangement of heat exchangers 82 and 81 as utilized in the dry air supply system 200 shown in FIG. 2A can also be utilized in the dry air supply system 100 shown in FIG. 1A, in lieu of the described serial arrangement, and also in dry air supply system 300, an all-transverse arrangement of principal sections that is shown in FIG. 3 and described further below. A parallel arrangement may offer increased thermodynamic efficiency, whereas the serial arrangement offers simpler ductwork.

Where engine 87 is liquid cooled (as is preferred), it is additionally preferred that first heat exchanger 82 of dry air supply system 200 comprises a liquid-to-gas heat exchanger, such as a coil placed in first HX path 251A of reactivation air path 251. Suitable coils for this application are commercially available, such as a four-row Heatcraft® heat transfer coil, available from Heatcraft, Inc., S. Grenada, Miss. USA. As shown in FIG. 2B, first heat exchanger 82 is connected via supply pipe 91 of piping 90 to receive radiated thermal energy contained in the liquid engine coolant of internal combustion engine 87 (the coolant being diverted to supply pipe 91 from the coolant circuit of engine 87 via a diverter valve not shown). Some of the radiated thermal energy is transferred within first heat exchanger 82 to air drawn along first HX path 251A. A boost pump 295, shown for example in FIG. 2B, can optionally be provided in piping 90 to assist in circulating the engine coolant through first heat exchanger 82. It is generally preferred that the thermal energy requirements and operation of first heat exchanger 82 of dry air supply system 200 be subordinated to the needs of internal combustion engine 87 of electric generator section 284 to maintain temperatures sufficiently elevated to oxidize VOC and other pollutants generated as a byproduct of combustion.

Figure 2C:
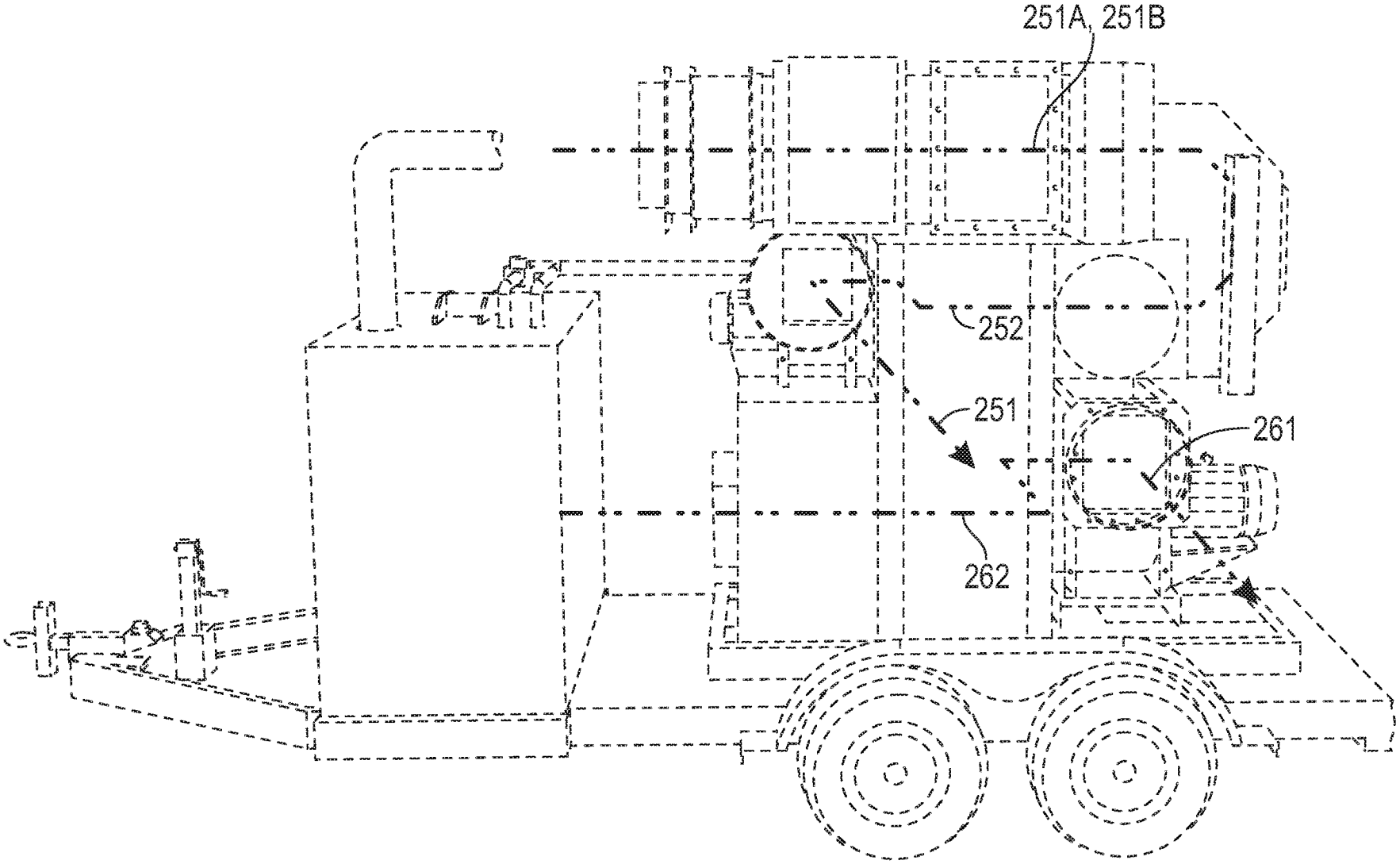
FIGS. 2C and 2D respectively are side and top views that depict the air and exhaust gas flow paths of the present invention, with the dry air supply system of FIGS. 2A and 2B depicted by dashed lines to better highlight those flow paths.
Figure 2D:
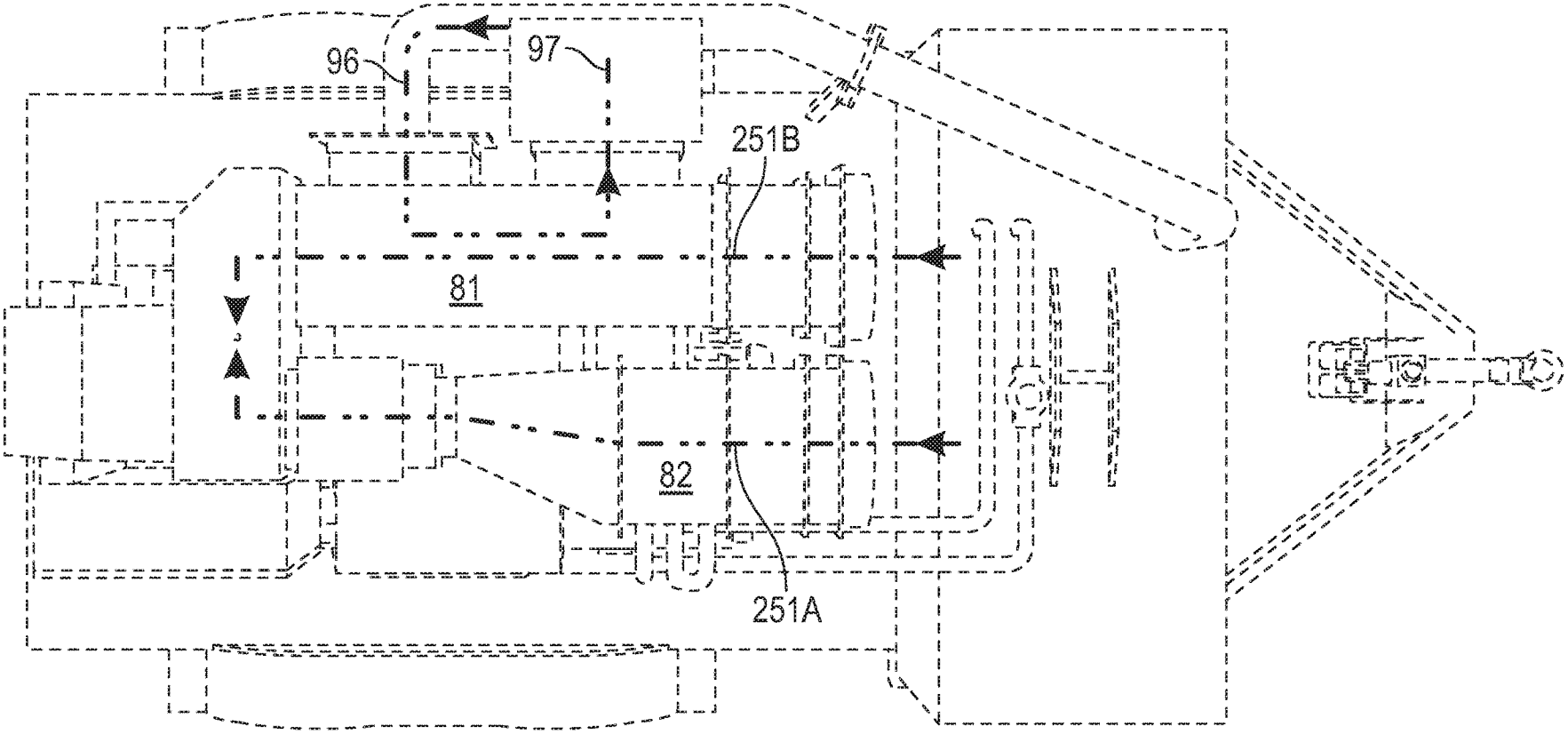

It is also preferred that the second heat exchanger 81 (FIG. 2B) of dry air supply system 200 comprises a gas-to-gas heat exchanger. The design and construction of second heat exchanger 81 as utilized in dry air supply system 200 is substantially as described above in connection with dry air supply system 100, and as shown for example in FIG. 3. Second heat exchanger 81 is connected to the exhaust of internal combustion engine 87 via exhaust gas transfer pipe 18 to receive thermal energy contained in the hot exhaust gas stream 96, shown entering heat exchanger 81 in FIGS. 2D and 3. Some of this thermal energy is transferred within heat exchanger 81 to heat air drawn along second HX path 251B. The discharged exhaust gas stream 97, shown exiting heat exchanger 81 in FIGS. 2D and 3, is conducted to and discharged through exhaust unit 222. Exhaust unit 222 preferably includes a drip cap and low point drains (not shown) to allow for condensate collection and removal, since as the exhaust gas stream 96 passes through second heat exchanger 81, it may be sufficiently cooled to cause condensation. Relative to dry air supply system 100 shown in FIG. 1A, exhaust gas transfer pipe 18 and piping 90 of dry air supply system 200 are suitably rerouted, as shown in FIGS. 2A and 2B, to accommodate the respective orientations of sections 84 and 211.

It is preferred that second heat exchanger 81 of dry air supply system 200 be suitably designed and constructed for high temperature service, as described above in connection with dry air supply system 100. Likewise it is preferred that the fluid paths through second heat exchanger 81 of dry air supply system 200 have a counter-flow design; i.e., blower 24 draws air along second HX path 251B through second heat exchanger 81 in a direction opposite the direction of the exhaust gas flow 96 through second heat exchanger 81, as shown in FIG. 2D.

After heating air drawn along first HX path 251A in first heat exchanger 82, the engine coolant is returned via return pipe 92 of piping 90 to engine 87. After heating air drawn along second HX path 251B in second heat exchanger 81, the exhaust gas ultimately is discharged to the atmosphere through exhaust unit 222, as indicated above. Suitable pollution control and/or noise mitigation devices can be interposed in the exhaust gas path at appropriate locations.

Air Drying Section (210).

Air drying section 210 of dry air supply system 200 includes a desiccant wheel 14 mounted to rotate on a frame within section 210, and has the same general design as described above in connection with dry air supply system 100. Suitable desiccant wheels for utilization as desiccant wheel 14 in air drying section 210 of dry air supply system 200 are commercially available, such as a honeycomb silica gel desiccant wheel (42 inch diameter wheel for example), available from Munters Corporation, Amesbury, Mass. USA. By means of appropriate wall and/or ducting placement, there is defined within air drying section 210 a desiccant feed path 262 (a portion of dry air path 261) and a desiccant reactivation path 252 (a portion of reactivation air path 251), shown in FIG. 2C, each passing through desiccant wheel 14. Desiccant feed path 262 and desiccant reactivation path 252 of dry air supply system 200 preferably are appropriately arranged to provide a counter-flow design through desiccant wheel 14; i.e., blowers 24 and 26 draw air along desiccant feed path 262 (of dry air path 261) and along desiccant reactivation path 252 (of reactivation path 251) in opposite directions. Thus as shown in FIG. 2C, the flow in desiccant reactivation path 252 of reactivation air path 251 is from right to left in air drying section 210, whereas the flow in desiccant feed path 262 of dry air path 261 is from left to right in air drying section 210. The walls and/or ducting defining path desiccant reactivation 252 and desiccant reactivation path 262 are appropriately configured to keep paths 252 and 262 substantially separate.

Dry Air Supply System (300)

Figure 2E:
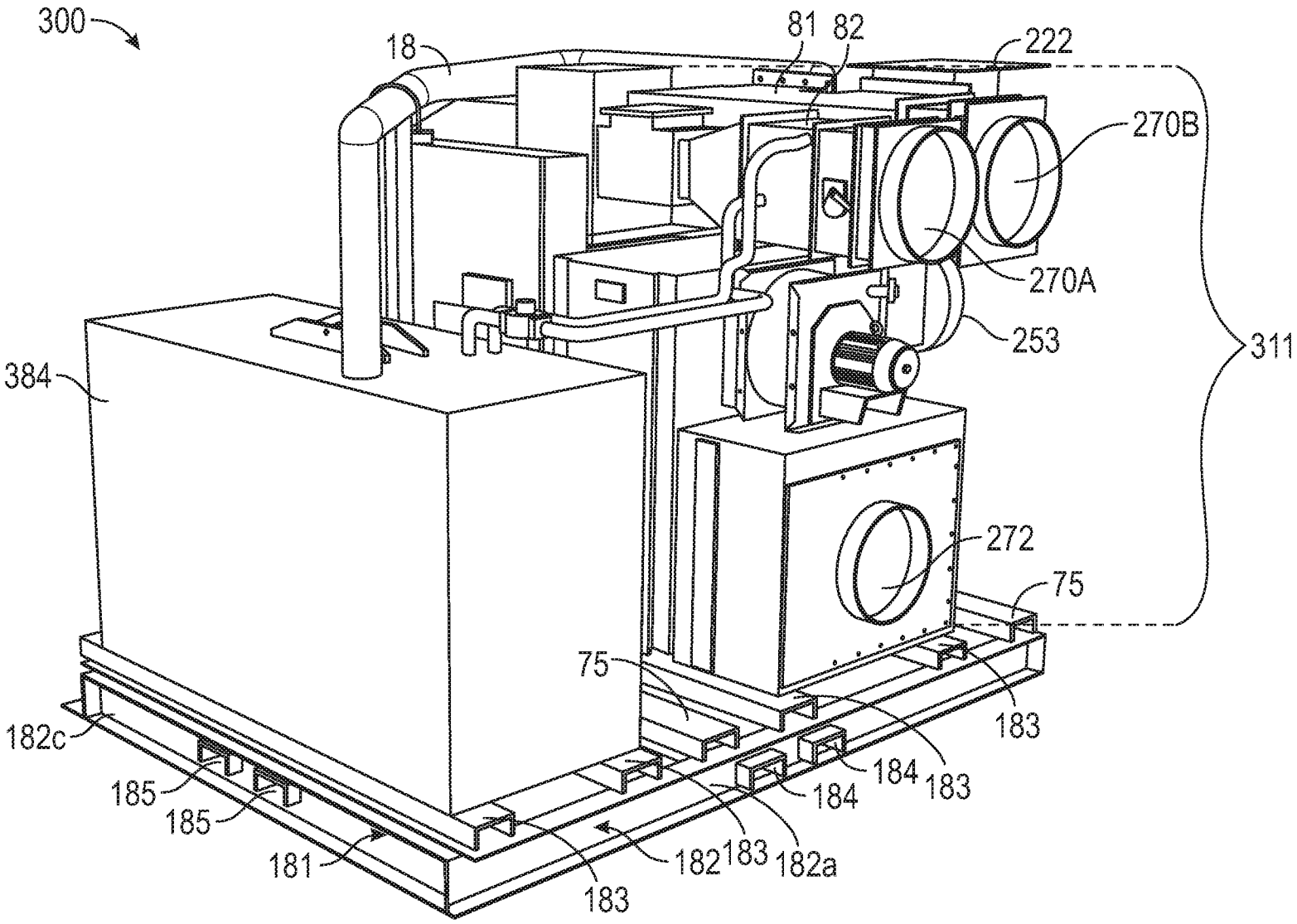
FIG. 2E is a schematic perspective view of a third embodiment of a dry air supply system in accordance with the present invention mounted on a skid.

Dry air supply system 300 is shown in FIG. 2E. The principal sections of dry air supply system 300 are electric generator section 384 and air handling section 311. The electric generator section 384 of dry air supply system 300 is substantially the same as electric generator section 84 described above in reference to dry air supply system 100. The air heating section 312 (not indicated) of dry air supply system 300 is substantially the same as air heating system 212 of dry air supply system 200; thus dry air supply system 300 is depicted as utilizing a parallel arrangement of first heat exchanger 82 and second heat exchanger 81, as in air heating section 212 of dry air supply system 200. In the alternative, dry air supply system 300 can utilize a serial arrangement of first heat exchanger 82 and second heat exchanger 81, as in air heating section 12 of dry air supply system 100.

Dry air supply system 300 differs from dry air supply systems 100 and 200 in respect of the orientation of its principal sections and its skid mounting, as described below.

Section Arrangement Configurations

The electric generator section of the dry air supply systems described herein (such as electric generator section 84, 284 or 384 of dry air supply system 100, 200 or 300 respectively) preferably is configured as a module having a generally rectangular footprint (i.e., one side being longer than the other). As a particular example, one commercially available diesel-electric generator suitable for use in dry air supply system 200 (Tecnogen Model KL45FQ, available from Tecnogen S.p.A., Pontenure, IT) has a generally rectangular footprint, with a length of about 91 inches (about 231 cm) and a width of about 37 inches (about 94 cm). Similarly, the air handling section of the dry air supply systems described herein (such as air handling section 11, 211 or 311 of dry air supply system 100, 200 or 300 respectively) also preferably will be configured as a module having a generally rectangular footprint.

For embodiments of the present invention intended for being mounted on a mobile carrier, such as a trailer (trailer 80 in the figures), such generally rectangular footprints of the principal sections (the electric generator section and the air handling section) afford three alternative mounting arrangements: an all-longitudinal arrangement of the principal sections, an all-transverse arrangement of the principal sections, and a longitudinal-transverse arrangement of the principal sections. In this disclosure, the "longitudinal" direction is approximately the direction in which trailer 80 rolls when towed, and the "transverse" direction is approximately perpendicular to the longitudinal direction (and approximately parallel to the surface on which trailer 80 rolls when towed). Also in this disclosure, the "length" of trailer 80 denotes the overall size of trailer 80 approximately parallel to the direction in which trailer 80 rolls when towed; and the "width" of trailer 80 denotes the overall size of trailer 80 approximately perpendicular thereto. In general, it is preferred that the weight of the principal sections be symmetrically positioned relative to the longitudinal centerline of trailer 80, so that the load is evenly distributed to the trailer chassis.

All-Longitudinal Arrangement

Figure 4A:
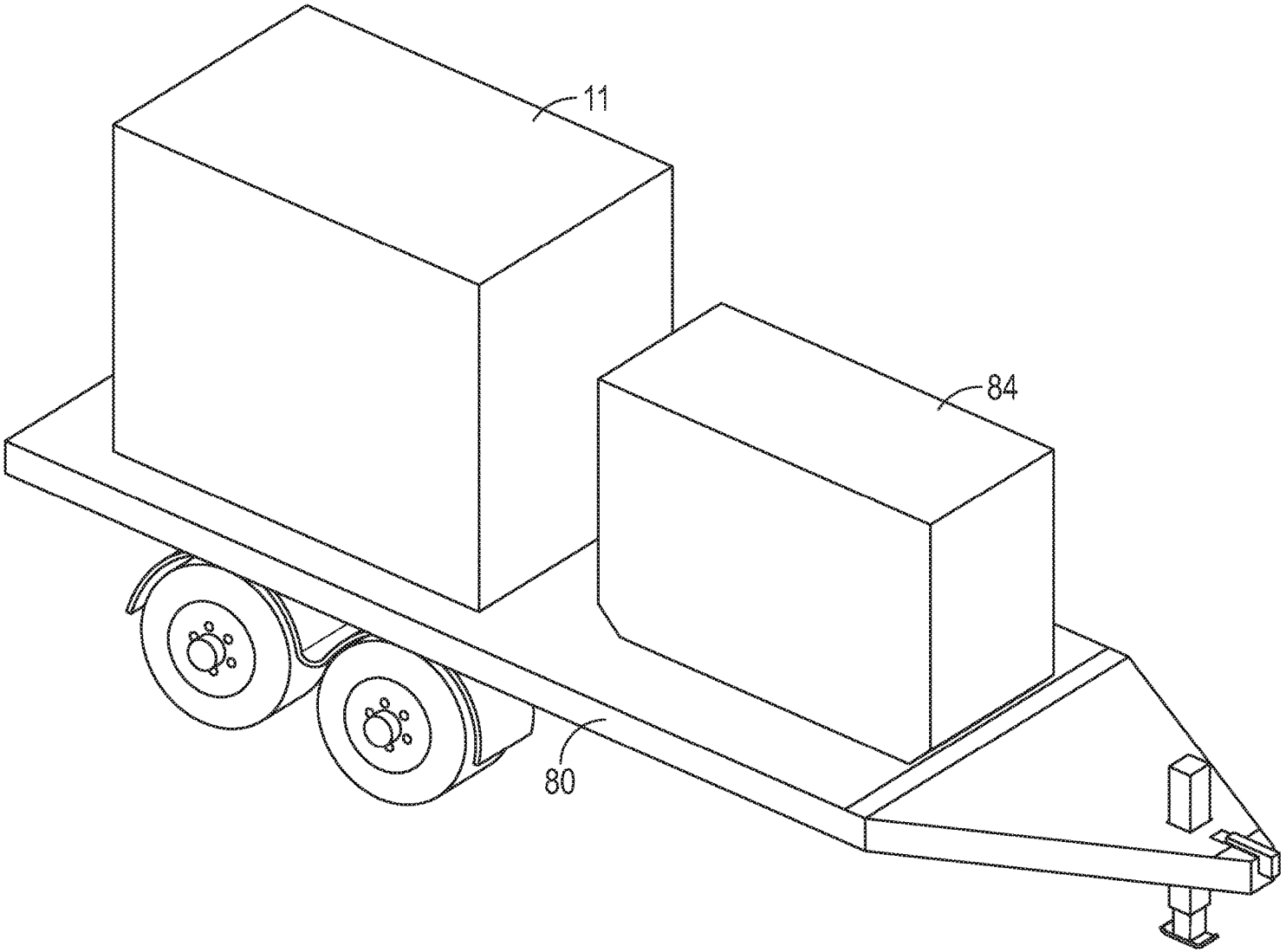
FIG. 4A is a schematic perspective view of an embodiment of a dry air supply system in accordance with the present invention having an all-longitudinal principal section arrangement and mounted on a truck trailer.

The all-longitudinal principal section arrangement is schematically depicted in FIG. 4A; the embodiment of FIGS. 1A-1B likewise has an all-longitudinal principal section arrangement. Generally in the all-longitudinal arrangement (and referring to the nomenclature of FIG. 1A for reference purposes), electric generator section 84 and air handling section 11 are positioned proximate to each other, with the longer sides of both electric generator section 84 and air handling section 11 being oriented approximately in the longitudinal direction; i.e., approximately parallel to the direction of travel of trailer 80. The sections 84 and 11 preferably are placed approximately equidistant from the sides of trailer 80, so that the weight of the sections is symmetrically distributed to the trailer chassis.

Longitudinal-Transverse Arrangement

Figure 4B:
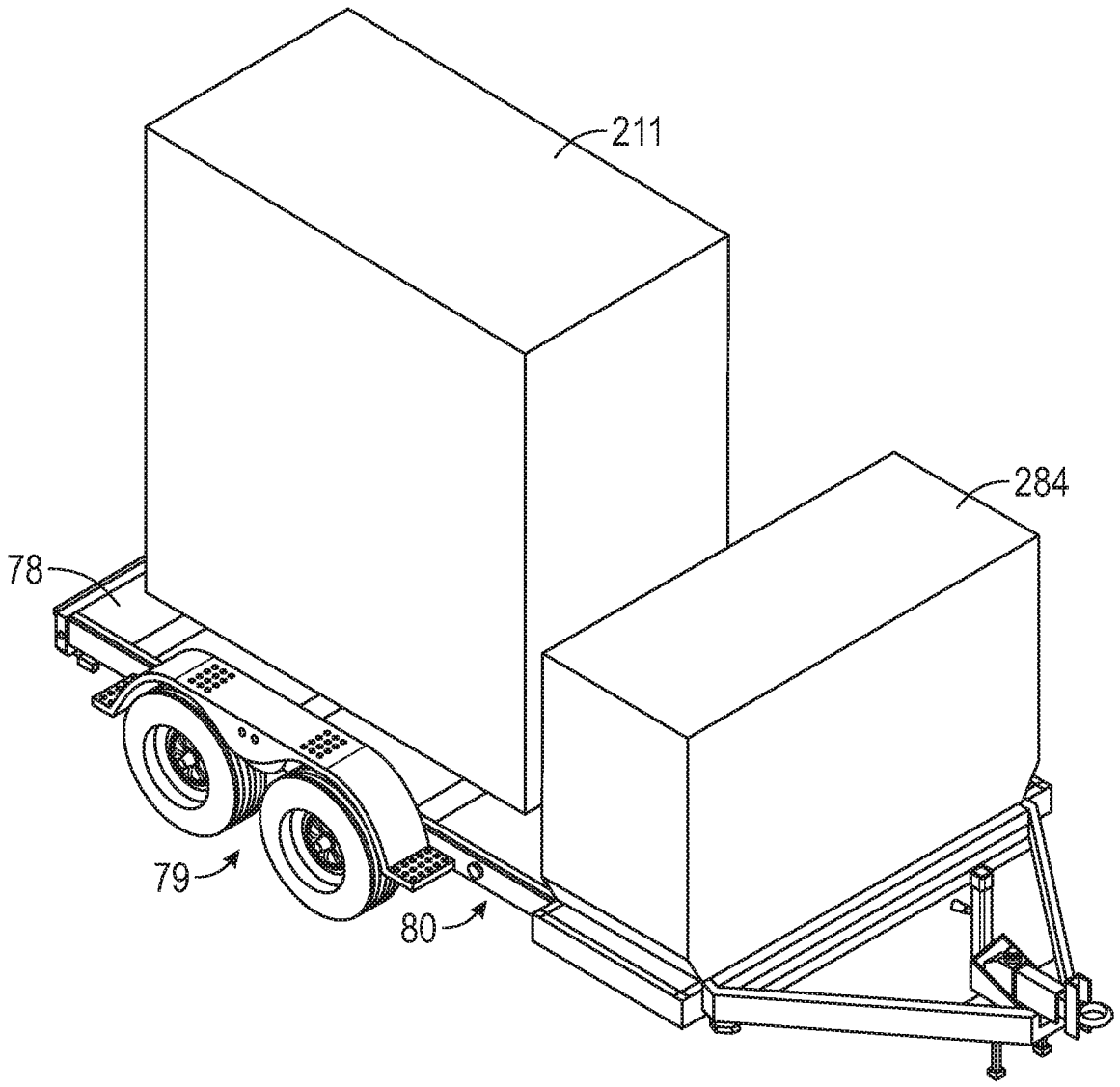
FIG. 4B is a schematic perspective view of an embodiment of a dry air supply system in accordance with the present invention having a longitudinal-transverse principal section arrangement and mounted on a truck trailer.

The longitudinal-transverse principal section arrangement is schematically depicted in FIG. 4B; the embodiment of FIGS. 2A-2D likewise has a longitudinal-transverse principal section arrangement. Generally in a longitudinal-transverse arrangement (and referring to the nomenclature of FIG. 2A for reference purposes), electric generator section 284 and air handling section 211 are positioned proximate to each other, with the longer side of one of either generator section 284 or air handling section 211 being oriented in the longitudinal direction (i.e., approximately parallel to the direction of travel of trailer 80), while the longer side of the other of either generator section 284 or air handling section 211 being oriented in the transverse direction (i.e., approximately perpendicular to the direction of travel of trailer 80 and approximately parallel to the ground). This arrangement lends itself to the situation where the length of one of the generator section and the air handling section exceeds a desired width design constraint (such as governmental regulations regarding width for road transport), but the length of the other of generator section 284 or air handling section 211 does not exceed the desired width design constraint.

For example, it can be the case that the length of electric generator section 284 is less than the desired width design constraint, allowing it to be transversely oriented, whereas the length of air handling section 211 exceeds the desired width design constraint, therefore warranting its longitudinal orientation. This is the arrangement of the embodiment shown in FIG. 4B (and also the embodiment of FIGS. 2A-2D). Notably in the embodiment of FIGS. 4B and 2A-2D, the width of air handling section 211 is less than the distance between the right-side set and the left-side set of wheels 79 of trailer 80 (the right-side set is visible in FIG. 4B, and the general positions of the left-side and right-side sets are visible in FIG. 2B). Thus as is shown in FIG. 4B, these dimensional relationships permit locating air handling section 211 between the right-side set and the left-side set of wheels 79 of trailer 80, and thus permit (as compared for example to FIG. 4C) lowering the height above the ground of the bed 78 of trailer 80, to reduce the overall height of the mobile apparatus. At the same time, the longitudinal-transverse arrangement of the embodiment in FIG. 4B reduces the length of trailer 80 as compared to an all-longitudinal arrangement, such as the embodiment of FIGS. 1A and 4A. A comparable overall reduction in the height of the mobile apparatus may also be available with the all-longitudinal principal section arrangement depicted in FIG. 4A (except where trailer 80 bears principal sections whose widths are not less than the width of trailer 80 between the wheel sets), but without the beneficial length reduction accruing to a longitudinal-transverse arrangement.

All-Transverse Arrangement

Figure 4C:
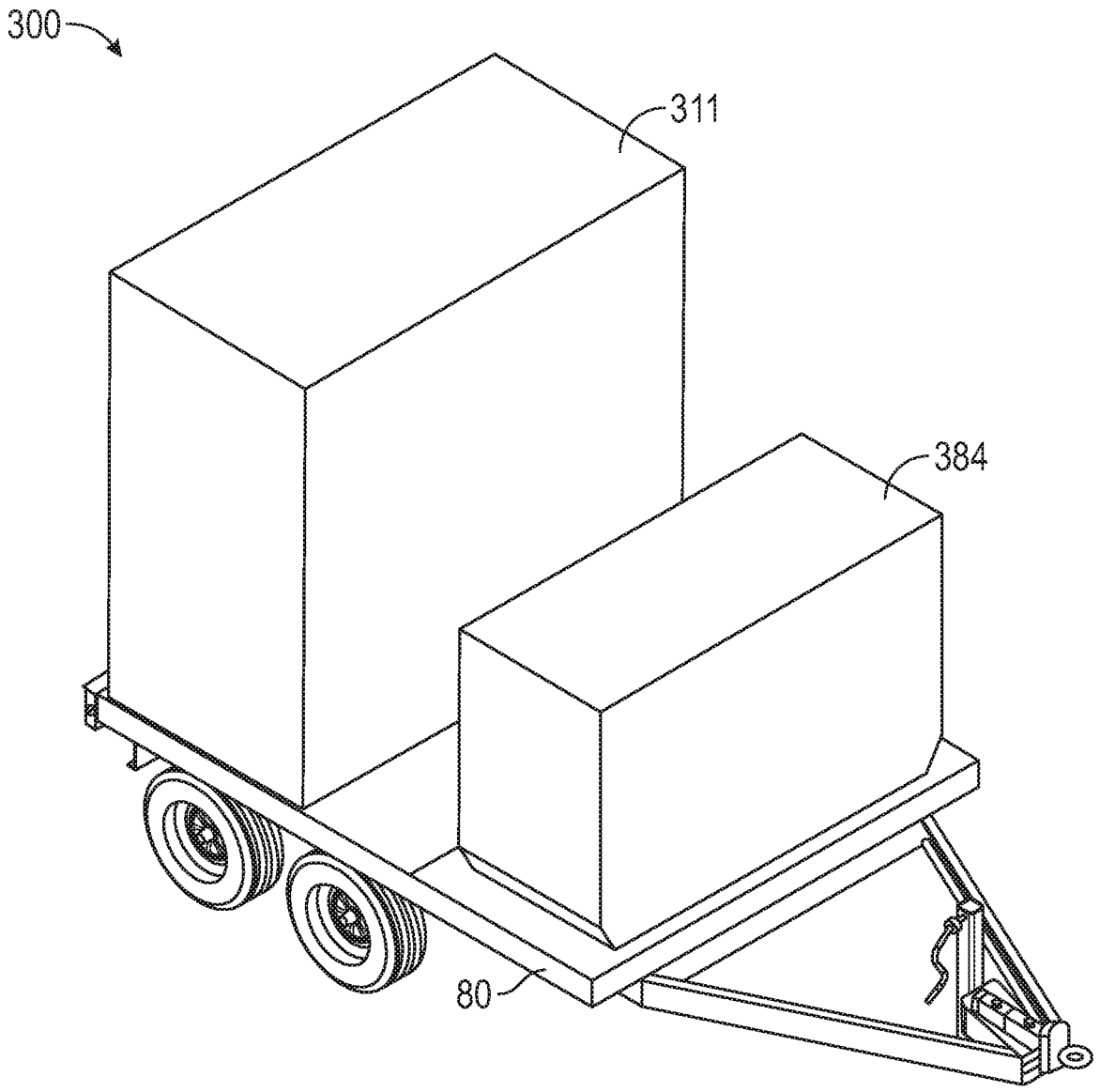
FIG. 4C is a schematic perspective view of an embodiment of a dry air supply system in accordance with the present invention having an all-transverse principal section arrangement and mounted on a truck trailer.

Dry air supply system 300 shown in FIG. 4C has an all-transverse principal section arrangement. In the all-transverse arrangement (and referring to the nomenclature of FIG. 4C for reference purposes), electric generator section 384 and air handling section 311 are positioned proximate each other, with the longer sides of both electric generator section 384 and air handling section 311 being oriented approximately in the transverse direction; i.e., approximately perpendicular to the direction of travel of trailer 80 and approximately parallel to the ground. An advantage to this arrangement is that the overall length of trailer 80 can be less than the all-longitudinal arrangement of for example dry air supply system 100, depicted in FIGS. 1A and 4A. The all-transverse arrangement can be a desirable arrangement where, referring to FIG. 4C, the longer sides of electric generator section 384 and air handling section 311 are relatively moderate; for example, where their lengths will result in the width of trailer 80 being in compliance with governmental regulations regulating maximum vehicle width.

Skid Mounting

As an alternative embodiment, rather than being positioned directly on a trailer 80, any of the dry air supply systems 100, 200 and 300 can be mounted on a skid for ease of movement, which optionally in turn can be placed on a trailer for ease of movement over more substantial distances. In this regard, the all-transverse arrangement shown in FIGS. 2E and 4C particularly lends itself to where the principal section components are skid mounted and could be handled by forklift pockets in the skid, making it practical even to place multiple systems on a tractor trailer. Additionally, a skid mounted design allows for movement of the dry air supply system and/or its principal section components over unimproved ground or via hoisting rings for crane lifting.

Skid Structure

FIG. 2E depicts dry air supply system 300 positioned on a skid 181.

Skid 181 has a four-sided perimeter defined by skid frame 182, which comprises for example four C-section steel channels 182*a*, 182*b*, 182*c* and 182*d*, fastened at their ends (for example, by bolting or welding) to form a rectangular shape. Thus channel 182*a* shown in FIG. 2E is equal in length and parallel to channel 182*b* (not visible), on the opposing side of skid 181, and channel 182*c* shown in FIG. 2E is equal in length and parallel to channel 182*d* (not visible) on the opposing side of skid 181.

In the embodiment of FIG. 2E, channels 182*a*, 182*b* are longer than channels 182*c*, 182*d*. Thus FIG. 2E depicts an all-transverse skid-mounted principal section arrangement; i.e., electric generator section 384 and air handling section 311 are positioned proximate each other, one behind the other along the length of and between channels 182*a*, 182*b*, with the shorter sides of both electric generator section 384 and air handling section 311 being oriented approximately parallel to the channels 182*a* and 182*b* forming the longer sides of skid 181. Correspondingly in FIG. 2E, the longer sides of both electric generator section 384 and air handling section 311 are oriented approximately parallel to the channels 182*c* and 182*d* forming the shorter sides of skid 181. Although depicted in an all-transverse principal section arrangement (shorter sides of the principal section components approximately parallel to the longer sides of skid 181), depending on the particular dimensions of electric generator section 384 and air handling section 311 skid 181 can be configured in a square shape, or with the shorter sides of the principal section components approximately parallel to the shorter sides of skid 181.

Four support rails 183 are positioned on and fastened to skid frame 182, at locations selected to permit positioning on and securing to a first pair of rails 183 electric generator section 384, and to permit positioning on and securing to a second pair of rails 183 air handling section 311. There can also be provided one or more stiffening beams 75, as shown for example in FIG. 2E, to contribute to the stiffening of skid frame 182.

Skid 181 additionally includes a first pair of spaced-apart forklift pockets 184 and a second pair of spaced-apart forklift pockets 185. Forklift pockets 184 are approximately parallel to channels 182*c* and 182*d* of skid frame 182, and approximately perpendicular to channels 182*a* and 182*b*. Forklift pockets 185 are approximately parallel to channels 182*a* and 182*b* of skid frame 182, and approximately perpendicular to channels 182*c* and 182*d* of skid frame 182. Forklift pockets 184 and 185 can be formed for example of a square section steel channel. The first pair of forklift pockets 184 are spaced apart from each other a distance to enable them to receive the forks of a forklift, and the second pair of forklift pockets 185 are spaced apart from each other a distance to enable them to receive the forks of a forklift.

As shown in FIG. 2E, each of the first pair of forklift pockets 184 pass through the web of channel 182*a* on one side of skid frame 182 and through the web of the channel 182*b* on the opposite side of skid frame 182. Forklift pockets 184 thereby span the distance from one side of skid frame 82 to the opposite side of skid frame 182, so as to permit forklift engagement either from the channel 182*a* side or from the channel 182*b* side. Also as shown in FIG. 2E, each of the second pair of forklift pockets 185 pass through the web of channel 182*c* on one side of skid frame 182 and through the web of channel 182*d* on the opposite side of skid frame 182. Forklift pockets 185 thereby span the distance from one side of skid frame 182 to the opposite side of skid frame 182, so as to permit forklift engagement either from the channel 182*c* side or from the channel 182*d* side.

Enclosure Frame

Figure 5A:
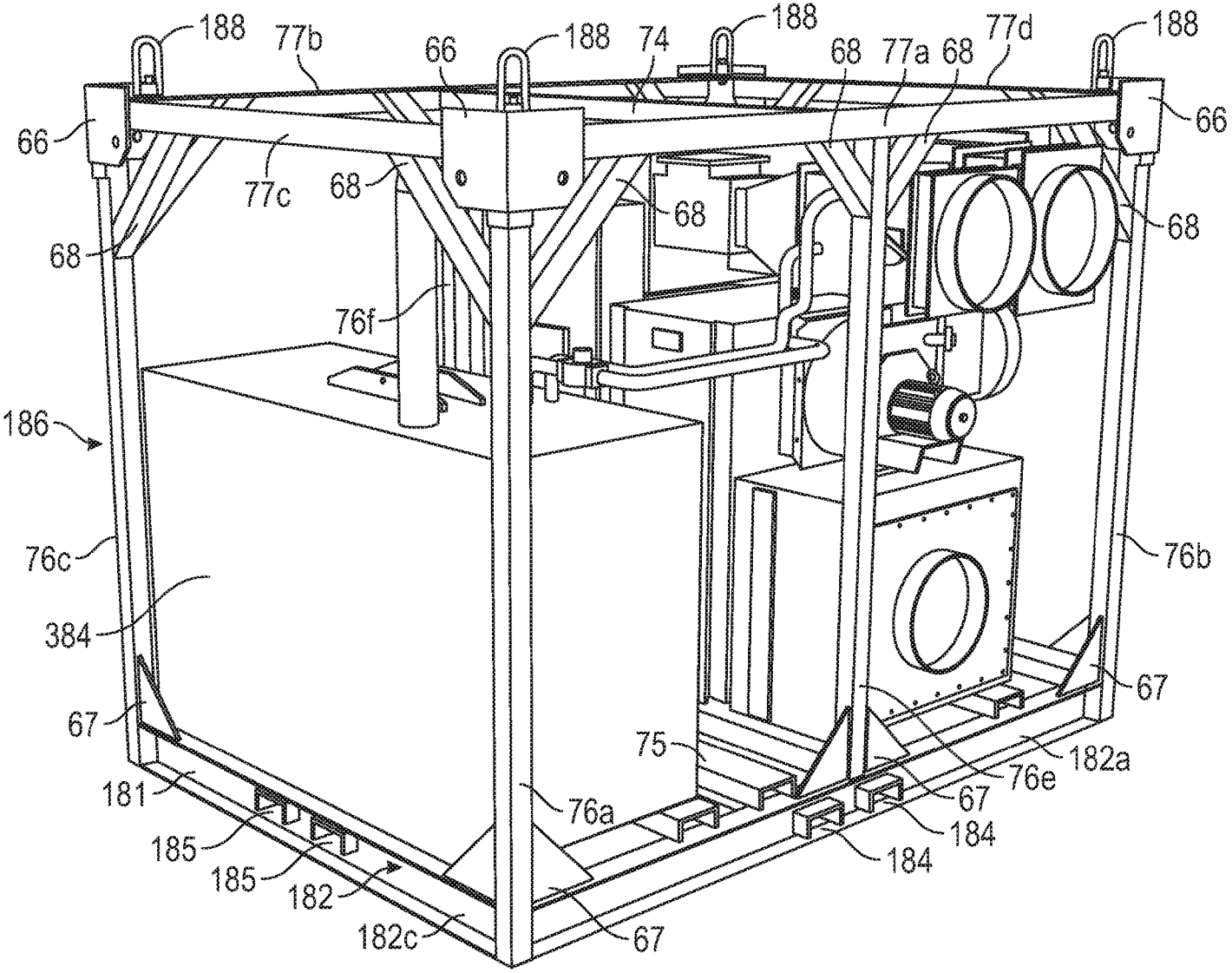
FIG. 5A is a schematic perspective view of a dry air supply system, in accordance with the embodiment depicted in FIG. 2E, including an enclosure frame.

Skid 181 optionally can be provided with an enclosure frame 186, shown in FIG. 5A. Enclosure frame 186 in the embodiment shown comprises six vertical posts 76*a*, 76*b*, 76*c*, 76*d*, 76*e* and 76*f*, and a top frame 77. Posts 76*a*-76*f* each comprises for example angle bar steel stock. Posts 76*a*-76*f* are positioned about the periphery of skid frame 182 of skid 181, with posts 76*a*-76*d* at the corners of skid 181, and posts 76*e*-76*f* at the approximate mid-point of channels 182*a* and 182*b* respectively of skid 181.

Posts 76*a*-76*f* support top frame 77. Top frame 77 comprises for example four steel angle bars 77*a*, 77*b*, 77*c* and 77, which are fastened at their ends, by bolts, welds or the like, to form a rectangular shape. One or more stiffening beams, such as stiffening beam 74 formed of steel angle bar and shown for example in FIGS. 5A and 5B, can be positioned across the interior of top frame 77 to provide additional rigidity.

The lower ends of posts 76*a*-76*f* are fastened to skid 181 by bolts, welds or the like, and the upper ends of posts 76*a*-76*f* are fastened to top frame 77 by bolts, welds or the like. Corner brackets 66, gussets 67 and corner braces 68, shown in FIG. 5A, can optionally be provided to further stiffen enclosure frame 86.

The four corners of top frame 77 are each provided with a hoist ring (optionally pivoting and/or swiveling), such as the four hoist rings 188 shown for example in FIG. 5A. Hoist rings 188 permit dry air supply system 300 to be moved by a crane hoist as desired.

Figure 5B:
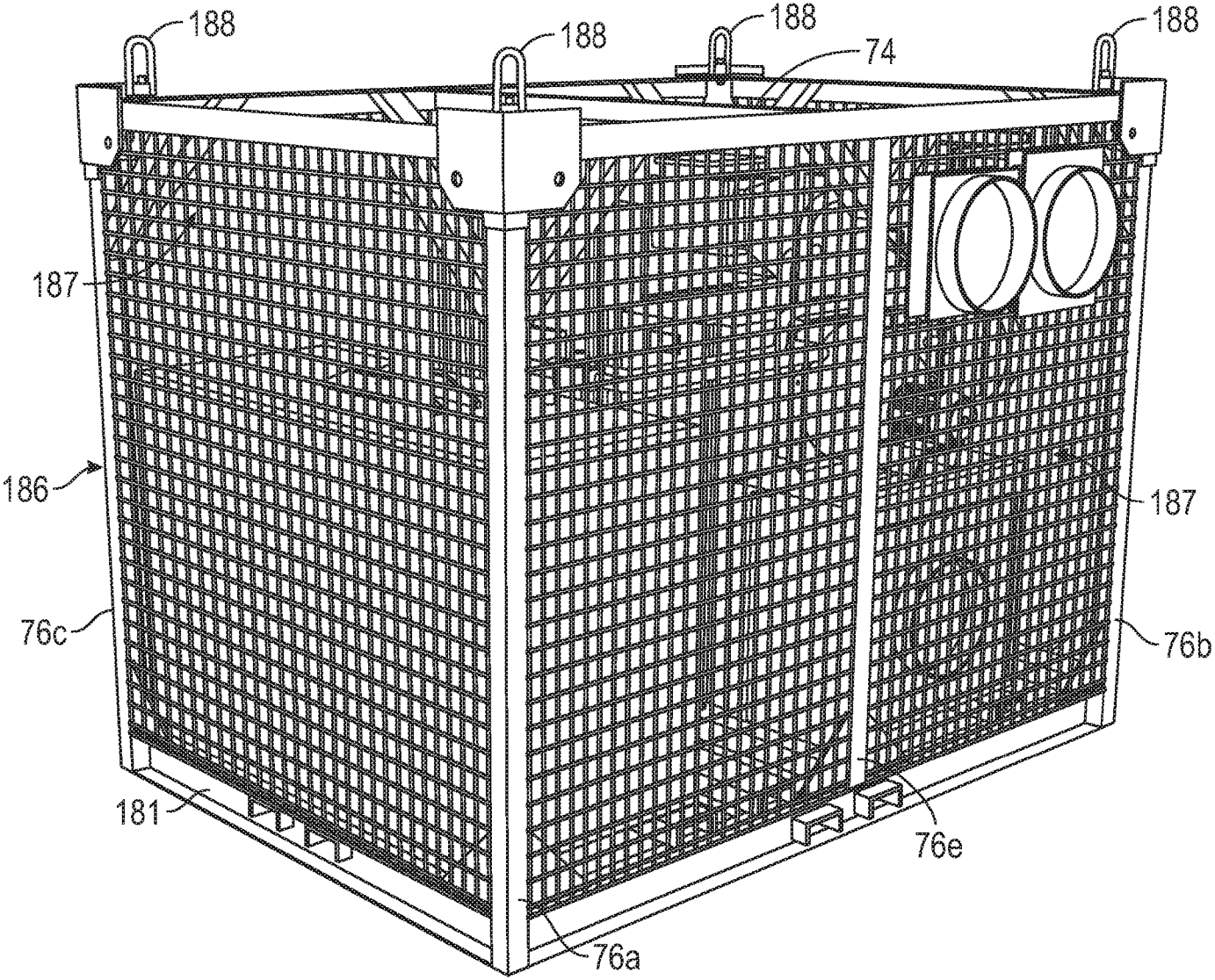
FIG. 5B is the same embodiment further including a protective boundary secured to the enclosure frame.

As shown in FIG. 5B, enclosure frame 186 can optionally be provided with a protective boundary 187 around its sides (and further optionally across top frame 77) to better protect dry air supply system 300 (electric generator section 384, air handling section 311 and their connections) during crane or forklift movement, and in the jobsite environment generally. Protective boundary 187 is resistant to impact and preferably comprises a foraminous material, such as sheet metal perforated with circular apertures at regular intervals, or the like. In the embodiment of FIGS. 5A and 5B, protective boundary 187 comprises wire mesh screening, fastened around the sides of enclosure frame 186 by removable screw fasteners or the like.

System Operation

Dry air supply systems 100, 200 and 300 in substantial respects operate in the same manner System operation is described below in reference to dry air supply system 100 shown in FIG. 1A, except as stated.

In operation, internal combustion engine 87 rotates electric generator 88, which energizes dry air blower 26 and reactivation blower 24, and turns desiccant wheel 14. Ambient air is thereby drawn along dry air path 61 through desiccant feed path 62 by dry air blower 26. The air so flowing passes through desiccant wheel 14. The desiccant in wheel 14 absorbs water from the air and thus dries the air. This dried air exits through dry air supply outlet 20 for delivery of dry air to the job site where the structure treatment operation is being conducted.

At the same time, ambient air is drawn along reactivation air path 51 by reactivation blower 24. In the case where a serial arrangement of heat exchangers 82 and 81 is utilized, such as described in connection with dry air supply system 100, the air flowing along air path 51 first passes through first heat exchanger 82, where it is heated by the transfer of radiated thermal energy contained in the engine coolant delivered from supply pipe 91. This heat transfer in turn cools the engine coolant, which is then returned to the internal combustion engine 87 through return pipe 92. After passing through first exchanger 82, the air flowing along the reactivation air path 51 passes through second heat exchanger 81, as indicated in FIG. 1B, where it is further heated by the transfer of thermal energy from hot exhaust gas stream 96 delivered from the engine 87 via engine exhaust gas transfer pipe 18. This heat transfer in turn cools the exhaust gas, which in the embodiment shown in FIG. 1 is then discharged into the ambient air through exhaust stack 22.

After having been heated by passing through first heat exchanger 82 and second heat exchanger 81, the heated air flowing along reactivation air path 51 next is drawn into air drying section 10, where it flows along desiccant reactivation path 52 to and through desiccant wheel 14. This heated air removes from the desiccant in wheel 14 water previously absorbed by the desiccant from the flow of air along desiccant feed path 62. This water removal reactivates the desiccant in wheel 14 for further use. Correspondingly, reactivation of the desiccant in wheel 14 causes water to be entrained in the air flowing through and from desiccant wheel 14 along desiccant reactivation path 52 of reactivation air path 51, to increase its moisture content and decrease its temperature. This moistened, cooled air is then drawn through reactivation blower 24 and discharged into the ambient air. Accordingly, dry air supply system 100 beneficially recaptures and employs, for use in reactivating the desiccant in wheel 14, both radiated thermal energy and thermal energy in the exhaust gas, which otherwise might be entirely or in substantial part unutilized.

Rotation of desiccant wheel 14 delivers and interposes reactivated desiccant on a continuous basis to and in desiccant feed path 62, to dry the air flowing along it, and to moisten the desiccant. Rotation of desiccant wheel 14 also delivers and interposes moisturized desiccant on a continuous basis to and in desiccant reactivation path 52, to moisten the air flowing along it, and to reactivate (dry) the desiccant. Because in the preferred embodiment the air drying section 10 features a counter-flow design (the air stream along desiccant reactivation path 52 of reactivation air path 51, and along desiccant feed path 62 of dry air path 61, flow through drying section 10 in opposite directions), the need for moisture having to migrate through the desiccant is lessened, thus requiring less energy.

In the case where a parallel arrangement of heat exchangers 82 and 81 is utilized, such as described in connection with dry air supply system 200, an air stream is drawn along first HX path 251A and passes through first heat exchanger 82, where it is heated by the transfer of radiated thermal energy contained in the engine coolant delivered from supply pipe 91. An air stream is also separately drawn along second HX path 251B and passes through second heat exchanger 81, where it is heated by the transfer of thermal energy from hot exhaust stream 96 delivered from the engine 87 via engine exhaust gas transfer pipe 18. The two heated air streams are then commingled in plenum 259, and the heated air continues through air drying section 210 along reactivation air path 251, in the same manner as described herein with respect to dry air supply system 100.

Figure 6:
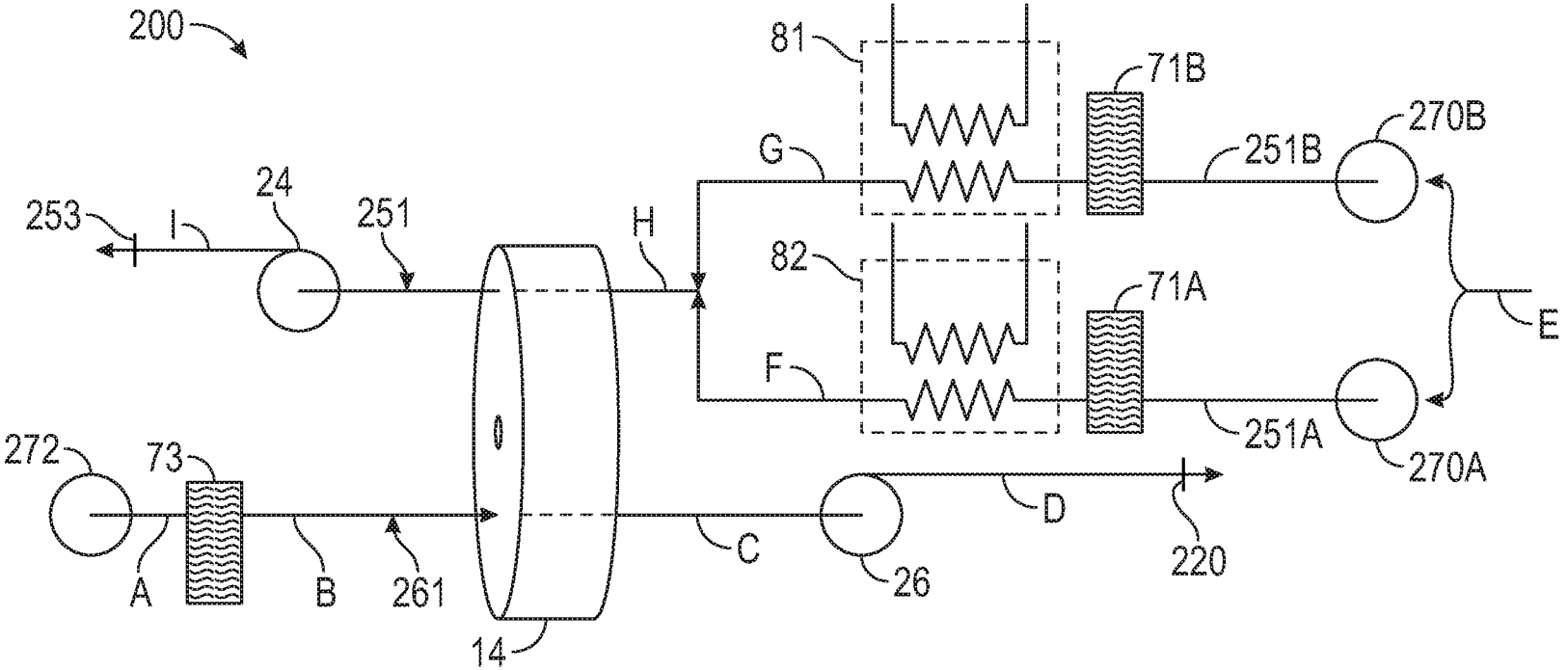
FIG. 6 is a schematic flow diagram and table depicting the air paths and psychometric conditions of air drying and desiccant reactivation according to the embodiment of the present invention depicted in FIGS. 2A-2D.

As an example of the performance of the dry air supply systems described herein, the state of the moisture content and temperature found at specific points along dry air path 261 and reactivation air path 251 of dry air supply system 200 is depicted in FIG. 6. In particular, an electric generator section 84 having a 74 HP internal combustion (diesel) engine 87 driving an electric generator 88 (rated at 40 kW standby and 36 kW prime) is utilized to generate power to deliver about 5,000 SCFM of dried air to dry air outlet 20, and to supply about 1,400 SCFM of heated air to reactivate desiccant wheel 14. In this example, the ambient air is at about 79° F. (26° C.) with a moisture content of about 78 gr./lb. (15.6 g/kg.; relative humidity of 51%), denoted points "A" and "E" in FIG. 6. Utilizing the system of the present invention, the air at the end of dry air path 261 (point "D") is delivered to dry air outlet 220 at a temperature of about 122° F. (50° C.) with a moisture content of about 37 gr./lb. (5.2 g/kg.) (relative humidity of 6%).

In turn, the ambient air is drawn into reactivation air path 251 (point "E"), with about 300 SFCM being drawn along first HX path 251A, passing through and heated by first heat exchanger 82, and with about 1,100 SFCM being drawn along second HX path 251B, passing through and heated by second heat exchanger 81. The heated air exiting first heat exchanger 82 has a temperature of about 400° F. (204° C.) (point "F"), and the heated air exiting second heat exchanger 81 has a temperature of about 170° F. (77° C.) (point "G"). After being commingled in plenum 259, the commingled air is delivered to the desiccant wheel 14 at a temperature of about 219° F. (104° C.) (point "H"). After passing through the desiccant wheel 14 and reactivating the desiccant, the air at the end of reactivation air path 251 (point "I") is delivered to reactivation air outlet 253 and discharged to the ambient air at a temperature of about 110° F. (43° C.) and a moisture content of about 224 gr./lb. (32.8 g/kg.) (relative humidity of 53%).

The foregoing detailed description is for illustration only and is not to be deemed as limiting the inventions, which are defined in the appended claims.

What is claimed is:

1. An apparatus for dehumidifying ambient atmospheric air comprising:

an enclosure assembly configured to define a first air path and a second air path, and containing a moisture-absorbing desiccant having a first dried state and a second moisturized state;

an internal combustion engine connected to supply exhaust gas containing thermal energy and connected to supply radiated thermal energy;

a heat exchanger system including first means for (a) receiving radiated thermal energy supplied by the internal combustion engine, and (b) transferring at least a portion of the radiated thermal energy to air drawn along the first air path to heat the air in the first air path; and second means for (a) receiving exhaust gas containing thermal energy supplied by the internal combustion engine, and (b) transferring at least a portion of the thermal energy from the exhaust gas to air drawn along the first air path to heat the air in the first air path;

a heat radiator;

means for directing a first portion of the radiated thermal energy from the internal combustion engine through a heat transfer circuit to the first means of the heat exchanger system, and directing a second portion of the radiated thermal energy to the heat radiator;

the first air path within said enclosure assembly connecting the ambient atmosphere to a reactivation air outlet through the heat exchanger system and the desiccant in the second moisturized state, and the second air path within said enclosure assembly connecting the ambient atmosphere to a dried air outlet through the desiccant in the first dried state;

a first blower configured to draw air from the ambient atmosphere along the first air path through the heat exchanger system to provide heated air, and to further draw the heated air along the first air path through the desiccant in the second moisturized state, to change the desiccant from the second moisturized state to the first dried state;

a second blower configured to draw air from the ambient atmosphere along the second air path through the desiccant in the first dried state, to provide dried air at the dried air outlet and to change the desiccant from the first dried state to the second moisturized state; and a mobile trailer on which is mounted the internal combustion engine, the enclosure assembly, the heat exchanger system, the first blower and the second blower.

2. The apparatus of claim 1, wherein the first and second blowers draw air along the first air path and along the second air path through the desiccant in opposite directions.

3. The apparatus of claim 1, further comprising an electric generator mounted on the mobile trailer, the electric generator driven by the internal combustion engine to generate electric power.

4. The apparatus of claim 3, configured so that the electric generator generates a first amount of electric power to power the first blower to draw air along the first air path and to power the second blower to draw air along the second air path.

5. The apparatus of claim 4, configured so that the electric generator generates a second amount of electric power in addition to the first amount of electric power, and further comprising an interface for connecting equipment to be powered by such second amount of electric power.

6. The apparatus of claim 1, wherein the first means and the second means of the heat exchanger system are arranged in series to serially transfer heat to air flowing along the first air path.

7. The apparatus of claim 6, wherein the first and second blowers draw air along the first air path and along the second air path through the desiccant in opposite directions.

8. The apparatus of claim 1, wherein the desiccant is provided on a rotatable wheel permeable to air flow.

9. The apparatus of claim 8, wherein the desiccant is provided on honeycombed flutes disposed on the rotatable wheel.

10. An apparatus for dehumidifying ambient atmospheric air comprising:

an enclosure assembly configured to define a first air path and a second air path, and containing a moisture-absorbing desiccant having a first dried state and a second moisturized state;

a heat exchanger system including first means for (a) receiving radiated thermal energy from an internal combustion engine, and (b) transferring at least a portion of the radiated thermal energy to air drawn along the first air path to heat the air in the first air path; and second means for (a) receiving exhaust gas containing thermal energy from the internal combustion engine, and (b) transferring at least a portion of the thermal energy from the exhaust gas to air drawn along the first air path to heat the air in the first air path;

the first air path within said enclosure assembly connecting the ambient atmosphere to a reactivation air outlet through the heat exchanger system and the desiccant in the second moisturized state, and the second air path within said enclosure assembly connecting the ambient atmosphere to a dried air outlet through the desiccant in the first dried state;

a first blower configured to draw air from the ambient atmosphere along the first air path through the heat exchanger system to provide heated air, and to further draw the heated air along the first air path through the desiccant in the second moisturized state, to change the desiccant from the second moisturized state to the first dried state; and a second blower configured to draw air from the ambient atmosphere along the second air path through the desiccant in the first dried state, to provide dried air at the dried air outlet and to change the desiccant from the first dried state to the second moisturized state, wherein the enclosure assembly is configured so that the first air path comprises a first heating path and a second heating path that is physically separated from the first heating path, wherein the first means of the heat exchanger system transfers radiated thermal energy to air drawn along the first heating path and not to air drawn along the second heating path, and the second means of the heat exchanger system transfers thermal energy from the exhaust gas to air drawn along the second heating path and not to air drawn along the first heating path, whereby the first means and the second means of the heat exchanger system are arranged in parallel to transfer heat to air flowing along the first air path.

11. The apparatus of claim 10, further comprising a plenum interposed in the first air path configured to receive a first stream of heated air drawn along the first heating path after being heated by the first means of the heat exchanger system, and to receive a second stream of heated air drawn along the second heating path after being heated by the second means of the heat exchanger system, to commingle the first stream of heated air and the second stream of heated air, and to redirect the commingled heated air along the first air path through the desiccant in the second moisturized state.

12. The apparatus of claim 11, wherein the first and second blowers draw air along the first air path and along the second air path through the desiccant in opposite directions.

13. A mobile apparatus for dehumidifying ambient atmospheric air comprising:

(I) an air handling section having a rectangular footprint with a first length and a first width smaller than the first length, the air handling section including an enclosure assembly, a heat exchanger system, a first blower and a second blower;

(II) an electric generator section having a rectangular footprint with a second length and a second width smaller than the second length, the electric generator section including an electric generator and an internal combustion engine that during operation rotates the electric generator to generate electric power, the internal combustion engine generating during operation radiated thermal energy and exhaust gas containing thermal energy;

(III) a mobile trailer adapted to roll in a longitudinal direction and defining a transverse direction perpendicular to the longitudinal direction, the air handling section and the electric generator section being mounted on the mobile trailer proximate to each other;

the enclosure assembly configured to define a first air path and a second air path, and containing a moisture-absorbing desiccant having a first dried state and a second moisturized state, the heat exchanger system including first means for (a) receiving radiated thermal energy from the internal combustion engine, and (b) transferring at least a portion of the received radiated thermal energy to air drawn along the first air path to heat the air in the first air path; and second means for (a) receiving exhaust gas containing thermal energy from the internal combustion engine, and (b) transferring at least a portion of the exhaust gas thermal energy from the exhaust gas to air drawn along the first air path to heat the air in the first air path;

the first air path comprises a first heating path and a second heating path that is physically separated from the first heating path;

the first means of the heat exchanger system transfers radiated thermal energy to air drawn along the first heating path and not to air drawn along the second heating path;

the second means of the heat exchanger system transfers thermal energy from the exhaust gas to air drawn along the second heating path and not to air drawn along the first heating path;

the first means and the second means of the heat exchanger system are arranged in parallel to transfer heat to air flowing along the first air path;

the first air path within said enclosure assembly connecting the ambient atmosphere to a reactivation air outlet through the heat exchanger system and the desiccant in the second moisturized state, and the second air path within said enclosure assembly connecting the ambient atmosphere to a dried air outlet through the desiccant in the first dried state;

the first blower powered by electric power received from the electric generator and configured to draw air from the ambient atmosphere along the first air path through the heat exchanger system to provide heated air, and to further draw the heated air along the first air path through the desiccant in the second moisturized state, to change the desiccant from the second moisturized state to the first dried state; and the second blower powered by electric power received from the electric generator and configured to draw air from the ambient atmosphere along the second air path through the desiccant in the first dried state, to provide dried air at the dried air outlet and to change the desiccant from the first dried state to the second moisturized state; and the air handling section being mounted on the trailer in an orientation such that the first length is parallel to either the longitudinal direction or the transverse direction, and the electric generator section being mounted on the trailer in an orientation such that the second length is generally parallel to either the longitudinal direction or the transverse direction.

14. The mobile apparatus of claim 13, wherein the first length is generally parallel to the longitudinal direction and the second length is generally parallel to the longitudinal direction.

15. The mobile apparatus of claim 13, wherein the first length is generally parallel to the transverse direction and the second length is parallel to the transverse direction.

16. The mobile apparatus of claim 13, wherein the first length is parallel to one of the longitudinal and transverse directions and the second length is parallel to the other of the longitudinal and transverse directions.

17. The mobile apparatus of claim 16, wherein the first length is parallel to the longitudinal direction and the second length is parallel to the transverse direction.

18. The mobile apparatus of claim 13, wherein the first and second blowers draw air along the first air path and along the second air path through the desiccant in opposite directions.

19. The mobile apparatus of claim 13, further comprising a heat radiator and means for directing a first portion of the radiated thermal energy from the internal combustion engine through a heat transfer circuit to the first means of the heat exchanger system, and a second portion of the radiated thermal energy to the heat radiator.

20. The mobile apparatus of claim 13, wherein the first means and the second means of the heat exchanger system are arranged to serially transfer heat to air flowing along the first air path.

21. The mobile apparatus of claim 20, wherein the first and second blowers draw air along the first air path and along the second air path through the desiccant in opposite directions.

22. The mobile apparatus of claim 13, further comprising a plenum interposed in the first air path configured to receive a first stream of heated air drawn along the first heating path after being heated by the first means of the heat exchanger system, and to receive a second stream of heated air drawn along the second heating path after being heated by the second means of the heat exchanger system, to commingle the first stream of heated air and the second stream of heated air, and to redirect the heated commingled air through the desiccant in the second moisturized state.

23. The mobile apparatus of claim 22, wherein the first and second blowers draw air along the first air path and along the second air path through the desiccant in opposite directions.

24. A mobile apparatus for dehumidifying ambient atmospheric air comprising:

an air handling section including an enclosure assembly, a heat exchanger system, a first blower and a second blower;

an electric generator section including an electric generator and a liquid-cooled internal combustion engine that rotates the electric generator to generate electric power, the internal combustion engine generating radiated thermal energy that is transferred to a liquid coolant and generating exhaust gas containing thermal energy;

a mobile platform selected from the group consisting of a trailer and a skid, with the air handling section and the electric generator section being mounted proximate to each other on the mobile platform;

the enclosure assembly configured to define a first air path and a second air path;

an air-permeable rotatable desiccant wheel included within the enclosure assembly and rotated by electric power received from the electric generator, the rotatable desiccant wheel containing a moisture-absorbing desiccant having a first dried state and a second moisturized state;

the heat exchanger system including a first heat exchanger that receives from the internal combustion engine liquid coolant containing radiated thermal energy, the first heat exchanger transferring at least a portion of such radiated thermal energy to air drawn along the first air path to heat the air in the first air path; and a second heat exchanger that receives exhaust gas containing thermal energy from the internal combustion engine, the second heat exchanger transferring at least a portion of the exhaust gas thermal energy from the exhaust gas to air drawn along the first air path to heat the air in the first air path;

the first air path within said enclosure assembly connecting the ambient atmosphere to a reactivation air outlet through the heat exchanger system and through desiccant in the second moisturized state contained on the rotatable desiccant wheel;

the second air path within said enclosure assembly connecting the ambient atmosphere to a dried air outlet through desiccant in the first dried state contained on the rotatable desiccant wheel;

the first blower powered by electric power received from the electric generator and configured to draw air from the ambient atmosphere along the first air path through the heat exchanger system to provide heated air, and to further draw the heated air along the first air path through desiccant in the second moisturized state contained on the rotatable desiccant wheel, to change the desiccant from the second moisturized state to the first dried state;

the second blower powered by electric power received from the electric generator and configured to draw air from the ambient atmosphere along the second air path through desiccant in the first dried state contained on the rotatable desiccant wheel, to provide dried air at the dried air outlet and to change the desiccant from the first dried state to the second moisturized state;

the first blower and second blower drawing air along the first air path and along the second air path through desiccant on the rotatable desiccant wheel in opposite directions; and the rotation of the desiccant wheel delivering on a continuous basis desiccant in the second moisturized state to the first air path so as to be changed to the first dried state, and desiccant contained in the first dried state to the second air path to be changed to the second moisturized state.

25. The mobile apparatus of claim 24, wherein the mobile platform is a trailer.

26. The mobile apparatus of claim 24, wherein the mobile platform is a skid.

27. The mobile apparatus of claim 26, further comprising a trailer on which the skid is removably positioned.

28. The mobile apparatus of claim 27, further comprising an enclosure frame mounted to the skid, the enclosure frame enclosing the air handling section and the electric generator section.

29. The mobile apparatus of claim 28, wherein the enclosure frame comprises a top frame and plural hoist rings secured to the top frame.

30. The mobile apparatus of claim 28, wherein the enclosure frame has four sides and further comprises a foraminous protective boundary around the four sides.

31. The mobile apparatus of claim 26, wherein the skid has four sides forming a rectangular shape and further comprises a first pair of forklift pockets spanning a distance between a first of the four sides and a second of the four sides opposite the first of the four sides, and a second pair of forklift pockets spanning a distance between a third of the four sides and a fourth of the four sides opposite the third of the four sides, the first pair of forklift pockets being oriented approximately perpendicular to the second pair of forklift pockets.

32. The mobile apparatus of claim 26, wherein the skid has four sides forming a rectangular shape that has a first length and a first width smaller than the first length, the air handling section has a rectangular footprint with a second length and a second width smaller than the second length, the electric generator section has a rectangular footprint with a third length and a third width smaller than the third length, the air handling section and electric generator section are positioned one behind the other along the first length of the skid with the second width and third width parallel to the first length, and with the second length and the third length parallel to the first width.

* * * * *